US007763089B2

(12) United States Patent
Ryan

(10) Patent No.: US 7,763,089 B2
(45) Date of Patent: Jul. 27, 2010

(54) DEBRIS RECEIVER

(75) Inventor: John W. Ryan, Boise, ID (US)

(73) Assignee: Drawervac, LLC, Boise, ID (US)

( * ) Notice: Subject to any disclaimer, the term of this patent is extended or adjusted under 35 U.S.C. 154(b) by 0 days.

(21) Appl. No.: 12/569,550

(22) Filed: Sep. 29, 2009

(65) Prior Publication Data

US 2010/0011533 A1 Jan. 21, 2010

Related U.S. Application Data

(60) Division of application No. 11/688,315, filed on Mar. 20, 2007, which is a continuation-in-part of application No. 11/500,213, filed on Aug. 7, 2006.

(60) Provisional application No. 60/744,599, filed on Apr. 11, 2006, provisional application No. 60/743,631, filed on Mar. 22, 2006.

(51) Int. Cl.
*B01D 53/00* (2006.01)

(52) U.S. Cl. ..... 55/429; 55/424; 55/428; 55/385.1; 55/DIG. 18; 454/49; 454/67; 312/330.1; 312/348.6; 312/1; 312/209; 312/211; 312/212; 312/229; 312/237

(58) Field of Classification Search ..... 55/424, 55/428, 429, DIG. 18, 385.1; 454/49–67; 312/330.1–348.6, 1, 209, 211, 212, 229, 312/237

See application file for complete search history.

(56) References Cited

U.S. PATENT DOCUMENTS

| | | | | |
|---|---|---|---|---|
| 4,227,902 | A * | 10/1980 | Olson | 55/302 |
| 5,408,721 | A | 4/1995 | Wall et al. | |
| 6,698,360 | B2 * | 3/2004 | Park | 108/50.13 |

FOREIGN PATENT DOCUMENTS

| | | | |
|---|---|---|---|
| CA | 675552 | A | 12/1963 |
| DE | 1974313 | U | 12/1967 |
| DE | 2913871 | A1 | 10/1980 |
| DE | 19544967 | A1 | 6/1997 |
| DE | 19815587 | A1 | 10/1998 |

* cited by examiner

*Primary Examiner*—Jason M Greene
*Assistant Examiner*—Dung Bui
(74) *Attorney, Agent, or Firm*—Zarian Midgley & Johnson PLLC

(57) ABSTRACT

In one embodiment, a debris receiving drawer is mounted in a receptacle bay slideable between a single closed position and an open position, wherein the drawer includes a basin, a channel from the basin, and an outlet from the channel. The basin is configured to guide debris entering the basin toward the channel and the channel is configured to channel debris to the outlet.

20 Claims, 26 Drawing Sheets

DEBRIS RECEIVER

CROSS REFERENCE TO RELATED APPLICATIONS

This is a divisional of application Ser. No. 11/688,315, filed Mar. 20, 2007, titled Debris Receiver, which is a continuation-in-part of application Ser. No. 11/500,213, filed Aug. 7, 2006, titled Debris Receiver, which claims subject matter disclosed in U.S. provisional patent application Ser. No. 60/744,599 filed Apr. 11, 2006, titled Central Vacuum System With Integrated Countertop Debris Collector and Ser. No. 60/743,631, filed Mar. 22, 2006, titled Central Vacuum System With Integrated Countertop Debris Collector.

BACKGROUND

Central vacuum systems, used increasingly in homes and businesses, provide centralized debris collection and eliminate the need to move around a heavy motor and collector bag or canister while cleaning. These systems are adapted to provide suction to many different areas in homes, offices and other facilities. In a typical conventional central vacuum system, suction ports located in walls and other concealed locations are accessed through long portable hoses that plug into the ports. Debris is collected through the hoses in much the same way that debris is collected with a portable vacuum except, of course, without the need to move around the motor and the collector bag or canister. Embodiments of the present invention were developed in an effort to facilitate removing debris from floors, countertops, desktops, work benches, and similar types of work surfaces utilizing components of a central vacuum system.

DRAWINGS

DETAILED DESCRIPTION

As used in this document: "drawer" means a sliding receptacle opened by pulling or pushing and closed by pushing or pulling; "port" means an opening for the intake or exhaust of air; "seal" means a device that prevents the passage of air into a passage or container; "suction" means reduced air pressure or the act or process of exerting a force upon a solid, liquid, or gaseous body by reason of reduced air pressure; and "valve" means a device by which the flow of liquid, gas, or loose material may be started, stopped, or regulated by a movable part that opens, shuts, or partially obstructs a port or passage.

Figure 1:
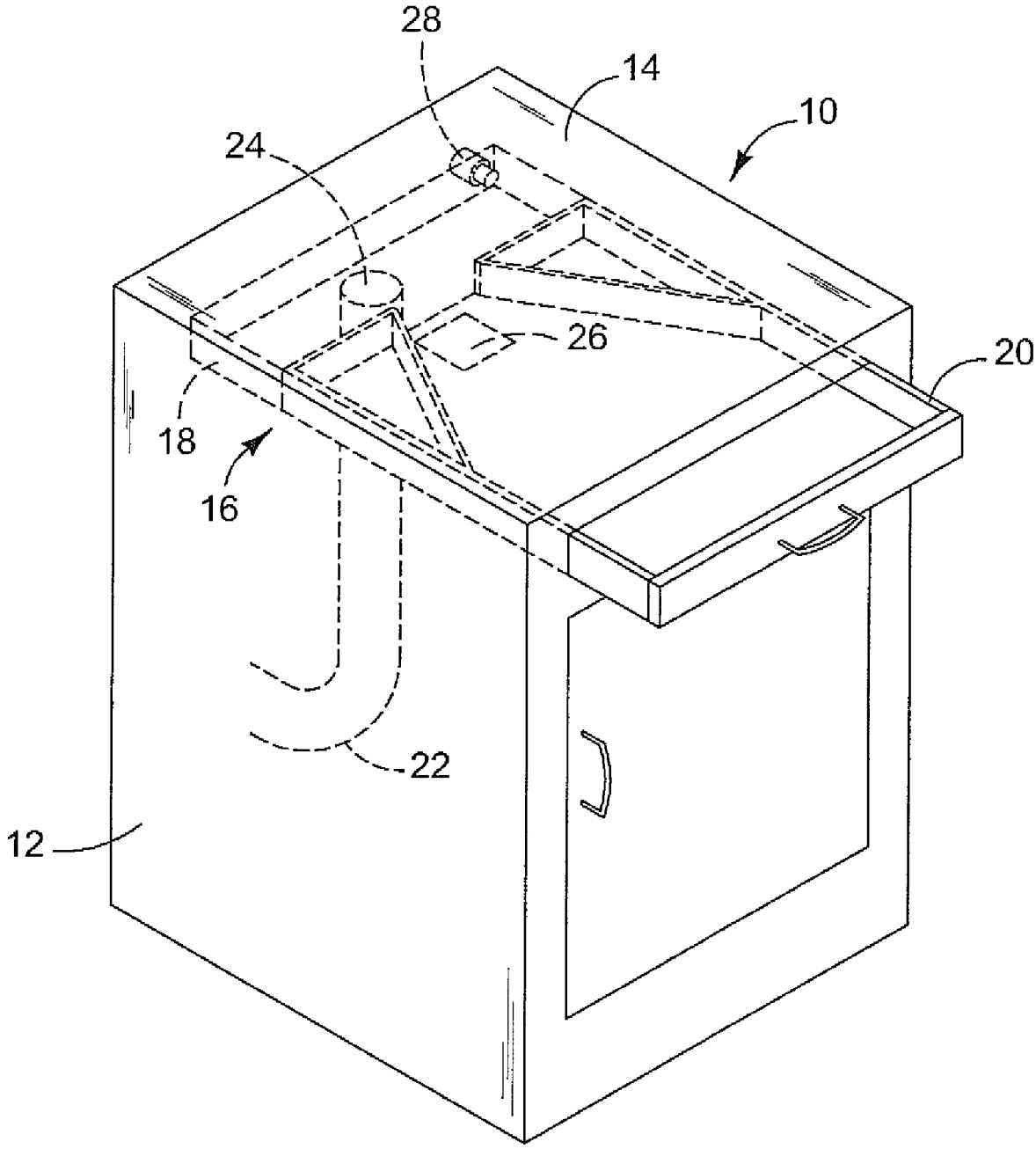
FIG. 1 illustrates a cabinet according to an embodiment of the invention for receiving debris off a countertop.

FIG. 1 illustrates one embodiment of a cabinet 10 such as might be utilized at various locations in a home or business. Referring to FIG. 1, cabinet 10 includes a base 12, a countertop 14 on base 12, and a debris receiver assembly 16 mounted in base 12 just below countertop 14. Receiver assembly 16 includes a drawer receptacle 18 fixed in base 12 and a debris receiving drawer 20 that slides in receptacle 18. A duct 22 runs from a suction port 24 at the back of receptacle 18 to a central vacuum (not shown in FIG. 1). Suction port 24 represents generally any suitable opening in receptacle 18 that allows suction supplied by the central vacuum through duct 22 to reach drawer 20 when drawer 20 is open. A seal 26 is positioned in the floor of drawer 20 to close suction port 24 when drawer 20 is closed and seal port 24 when suction is supplied to port 24. Hence, when drawer 20 is closed, the central vacuum can suck air in through other suction ports, if any, in the central vacuum system. A switch 28 may be used to automatically turn on the central vacuum when drawer 20 is opened and to automatically turn off the central vacuum when drawer 20 is closed. Switch 28 represents generally any suitable electrical, electronic, optical, or other switching device and circuitry operable to turn on the central vacuum when drawer 20 is opened and to turn off the central vacuum when drawer 20 is closed. If the central vacuum system includes other suction ports, switch 28 is configured to allow the central vacuum to run when drawer 20 is closed.

Seal 26 in drawer 20 functions as a valve that starts and stops the flow of air through drawer 20 into duct 22. If drawer 20 is closed, seal 26 closes and, when suction is supplied to port 24, seals suction port 24 so that air will not flow through drawer 20 into duct 22 when suction is supplied to port 24. If drawer 20 is open, suction port 24 is also open so that air will flow through drawer 20 into duct 22 when suction is supplied to port 24. The speed of air flowing through drawer 20 into duct 22 may be increased by minimizing the entry of air into receptacle 18 and duct 22 other than through the open drawer 20. Air will also flow faster through drawer 20 when drawer 20 is more closed and slower when drawer 20 is more open. Hence, as drawer 20 closes the rate of air flow increases to help draw debris in drawer 20 back into duct 22. As shown in FIG. 1, the sides of drawer 20 may be tapered towards the rear, behind the debris entry area, to help make the air flow faster and to direct debris toward suction port 24. Drawer 20 might also be tapered between the top and bottom toward the rear to help make the air flow faster behind the debris entry area.

Figure 2:
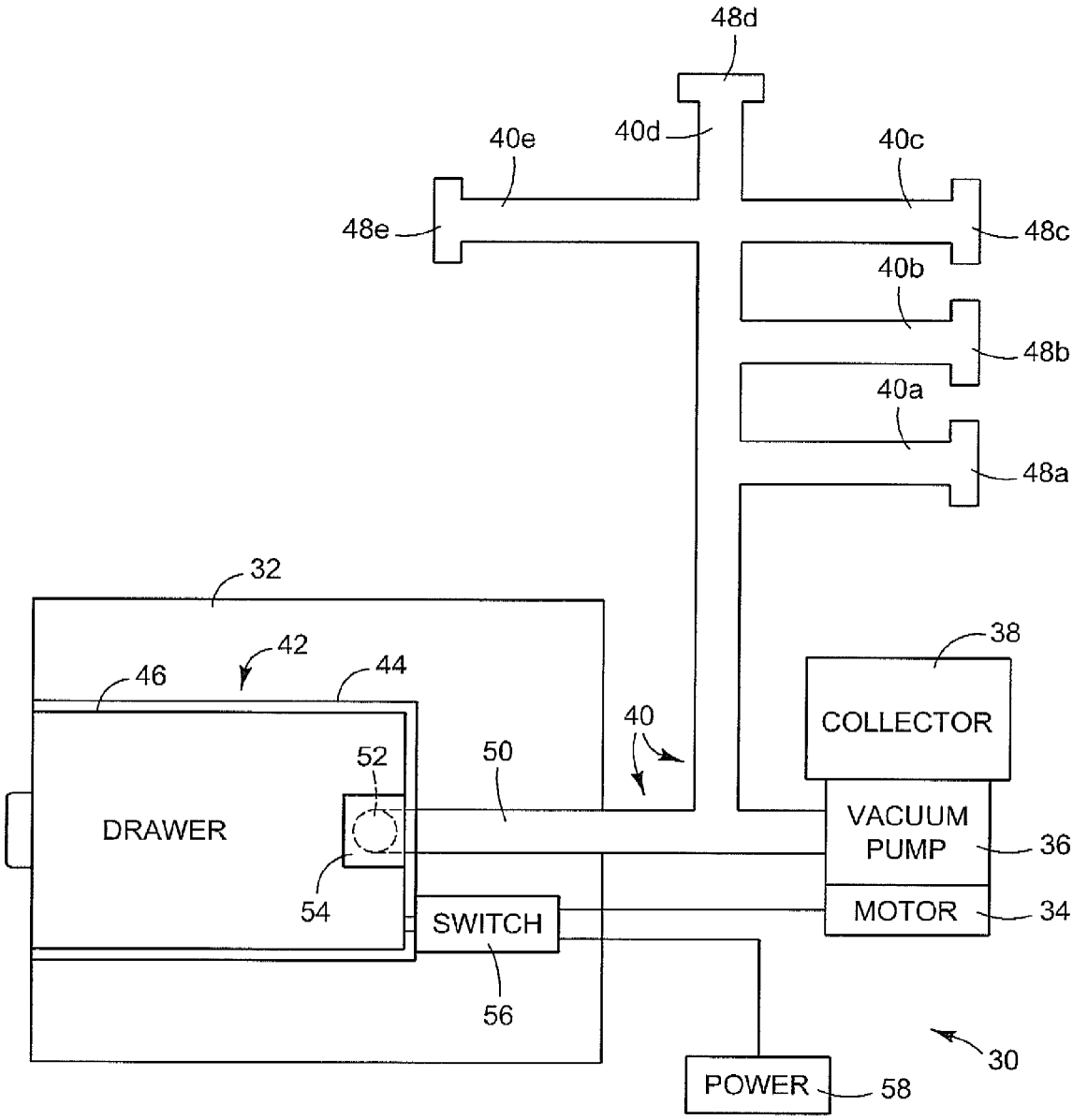
FIG. 2 illustrates a countertop debris collection system according to an embodiment of the invention.
Figure 3:
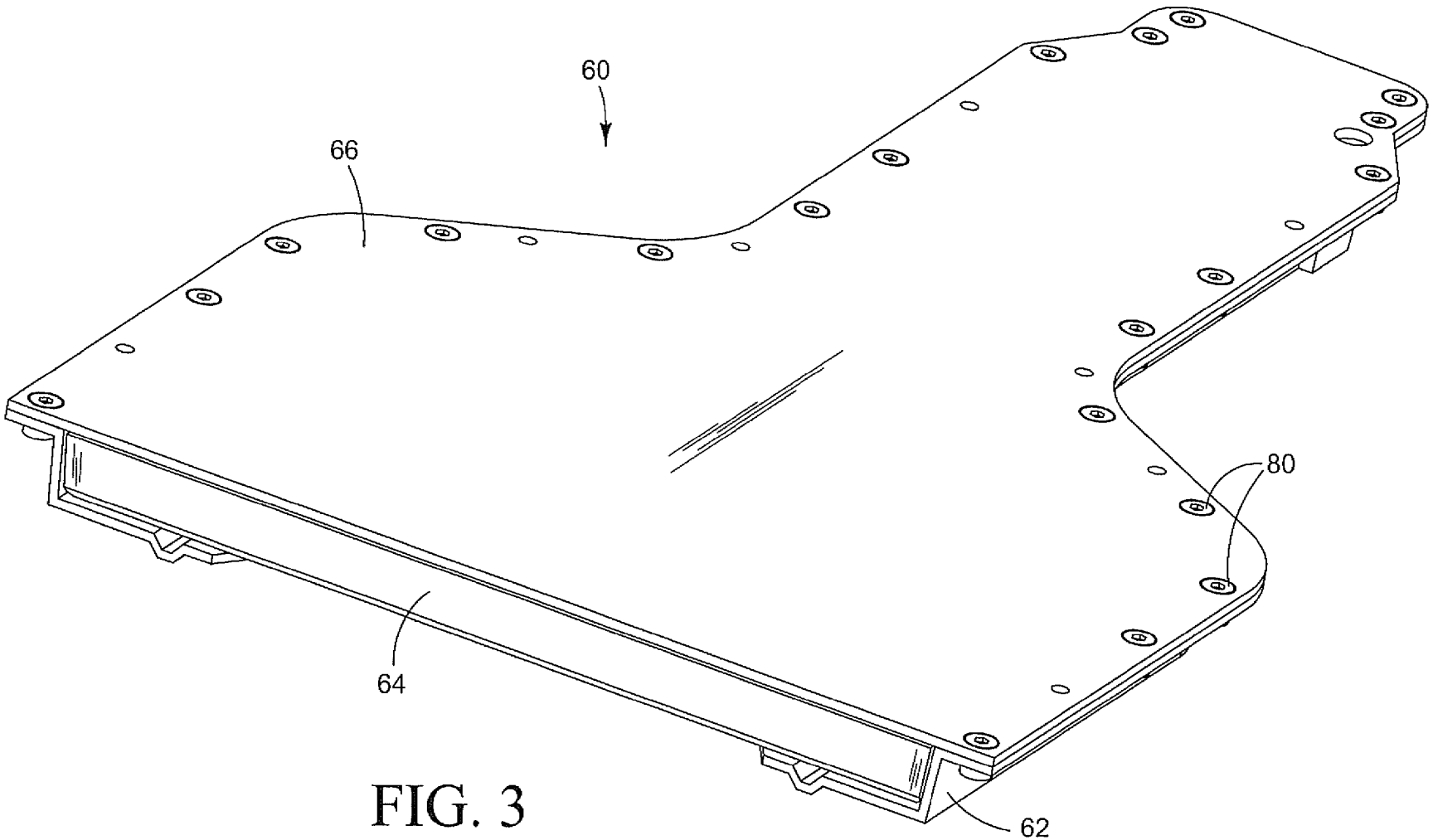
FIGS. 3-6 are perspective views of a debris receiver assembly according to one embodiment of the invention.

FIG. 2 is a block diagram illustrating a countertop debris vacuum collection system 30 utilizing, for example, a cabinet 32 such as the one shown in FIG. 1. Referring to FIG. 2, system 30 includes a motor 34, a vacuum pump 36, a collector 38, and ducting 40 typically used in conventional central vacuum systems. System 30 also includes a debris receiver assembly 42 mounted in cabinet 32. Receiver assembly 42 in FIG. 2 includes a drawer receptacle 44 fixed in cabinet 32 and a debris receiving drawer 46 that slides in receptacle 44. Ducting 40 in system 30 will usually include multiple ducts 40*a*-40*e* to multiple suction ports 48*a*-48*e* in addition to duct 50 to suction port 52 in cabinet 32. A seal 54 operatively connected to drawer 46 seals suction port 52 when drawer 46 is closed and suction is supplied to port 52. A switch 56 operatively connected to drawer 46 automatically turns on pump 36 with the use of power supply 58 when drawer 46 is opened and automatically turns off pump 36 when drawer 46 is closed.

In operation, opening drawer 46 opens suction port 52 and "activates" switch 56 to the on position to start vacuum pump 36. Pump 36 supplies suction to port 52 at the back of receptacle 44 through duct 50. Any debris swept off the top of cabinet 32 or otherwise dumped into the open drawer 46 is sucked through the rear of drawer 46, into receptacle 44, and then into duct 50 through suction port 52 and on to collector 38. Closing drawer 46 closes suction port 52 and "deactivates" switch 56 to turn off vacuum pump 36.

Figure 4:
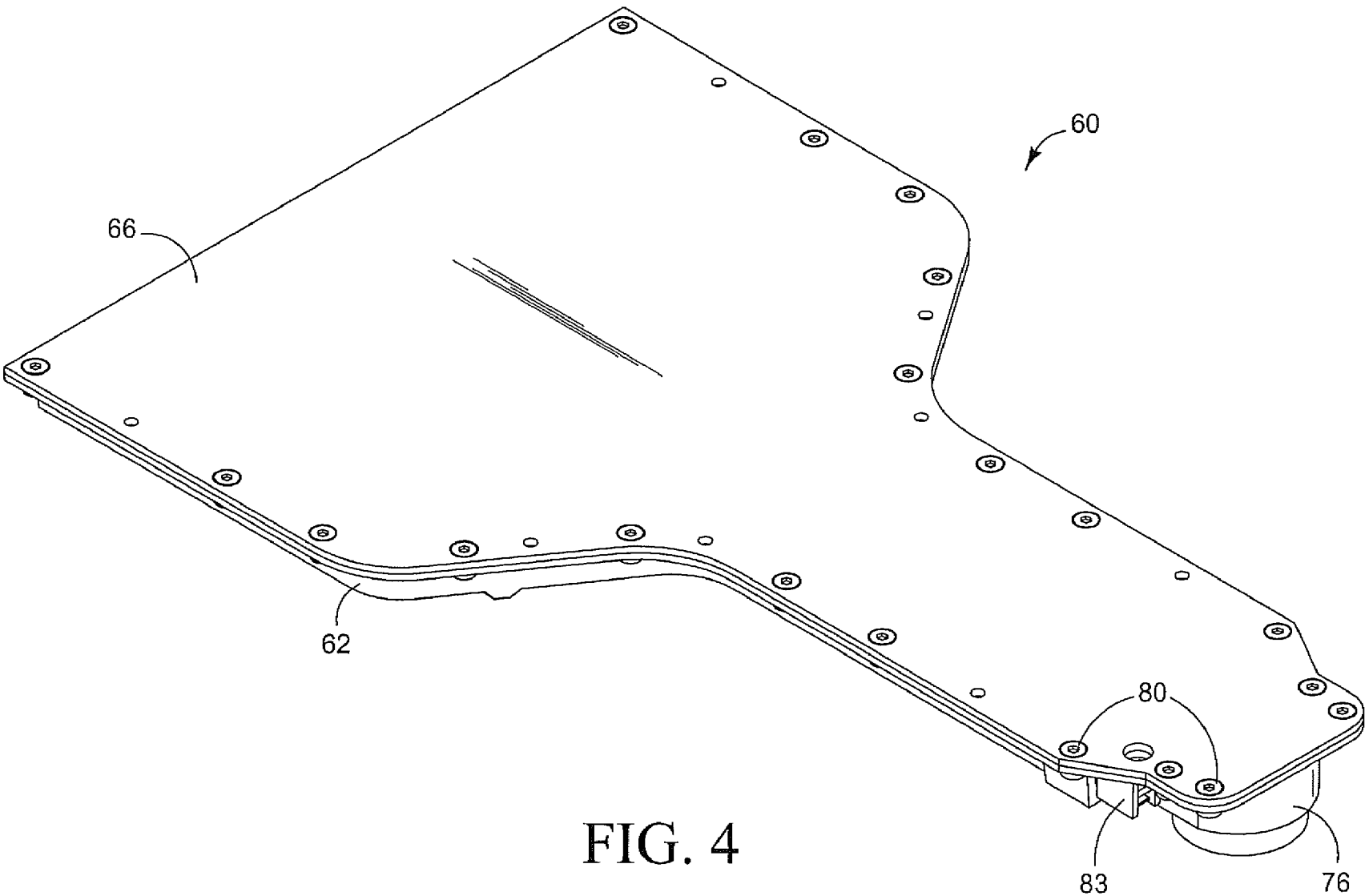
Figure 5:
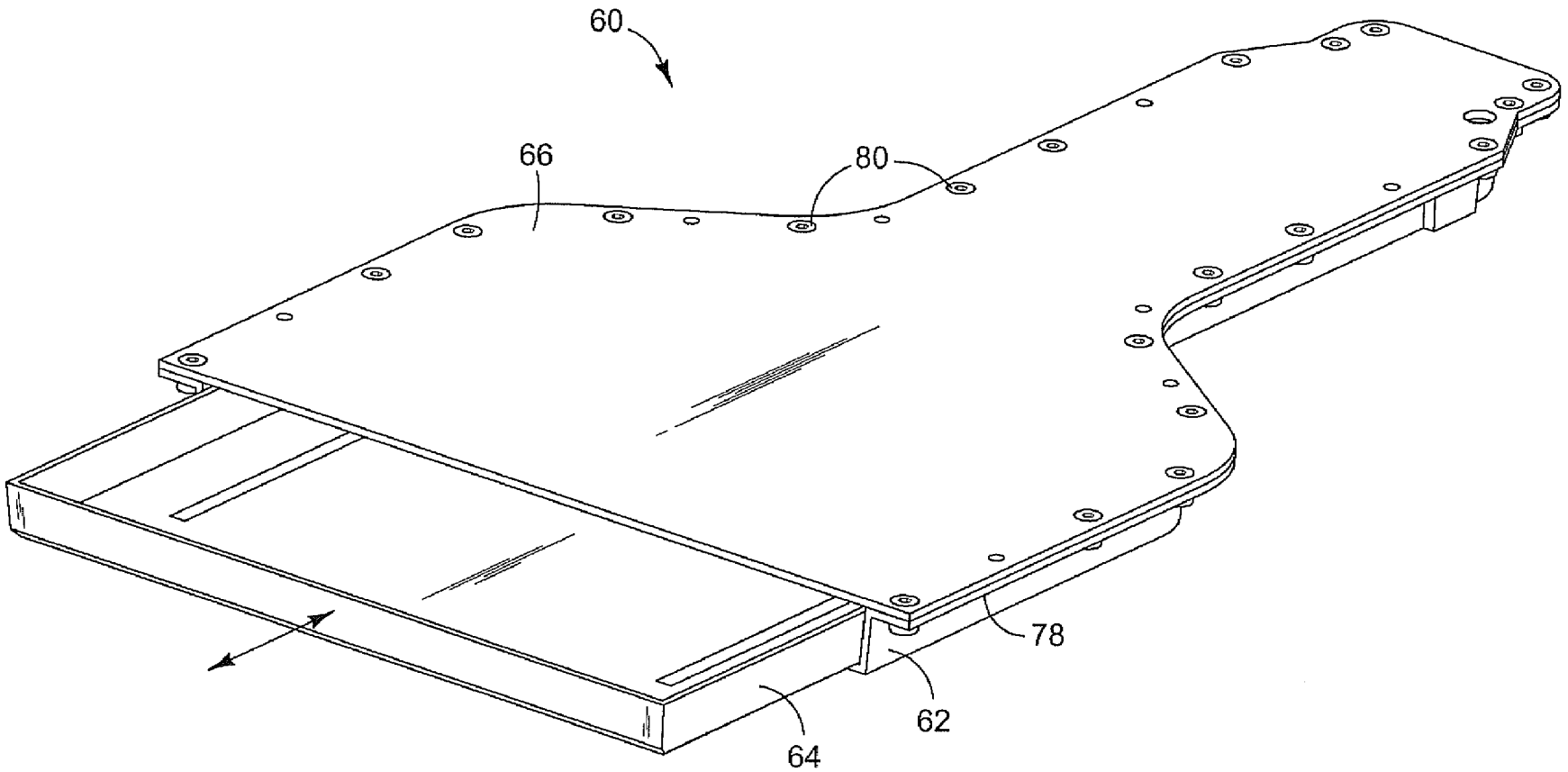
Figure 7:
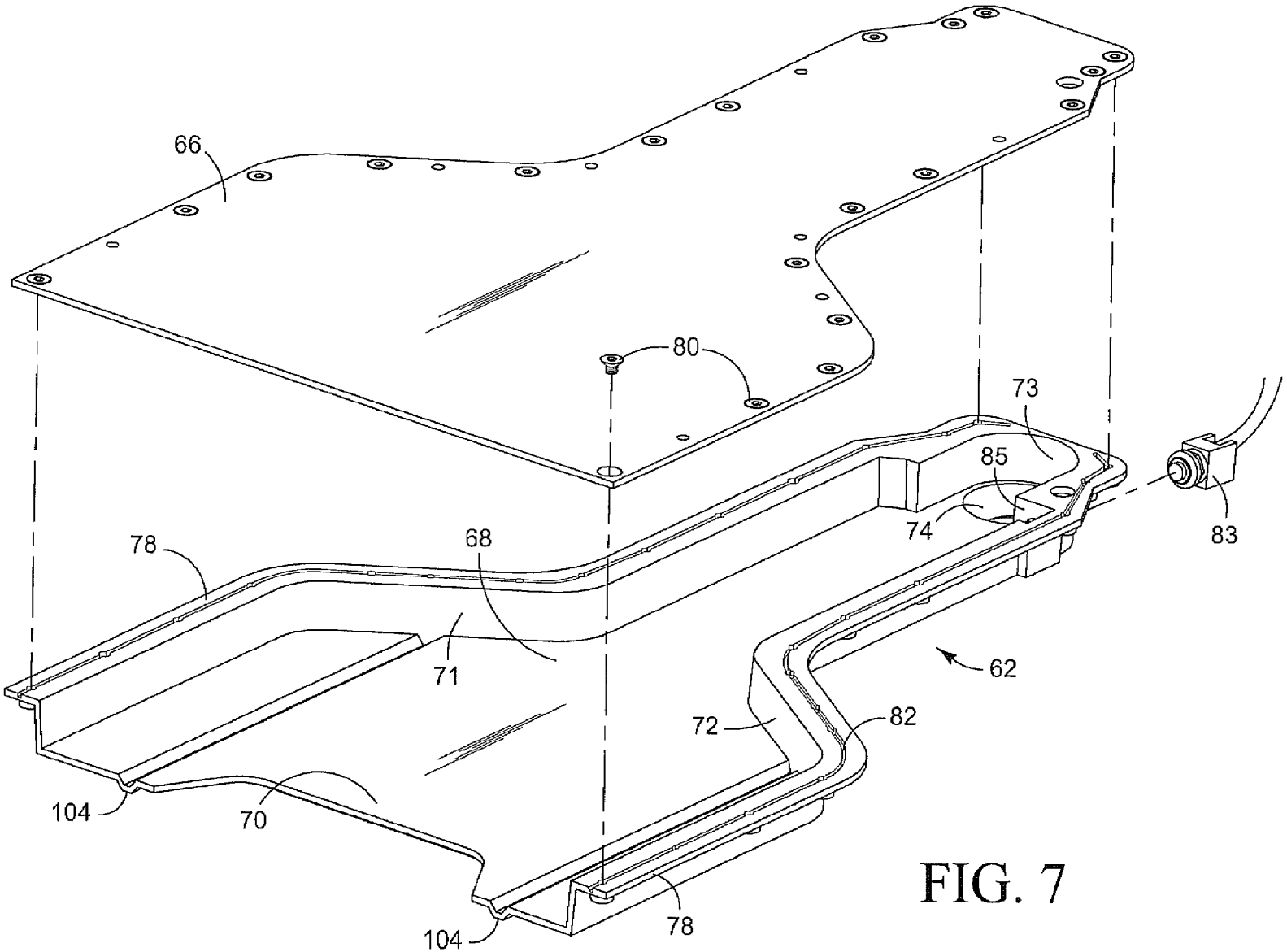
FIG. 7 is a detailed exploded view of the drawer receptacle and cover in the assembly of FIGS. 3-6.
Figure 8:
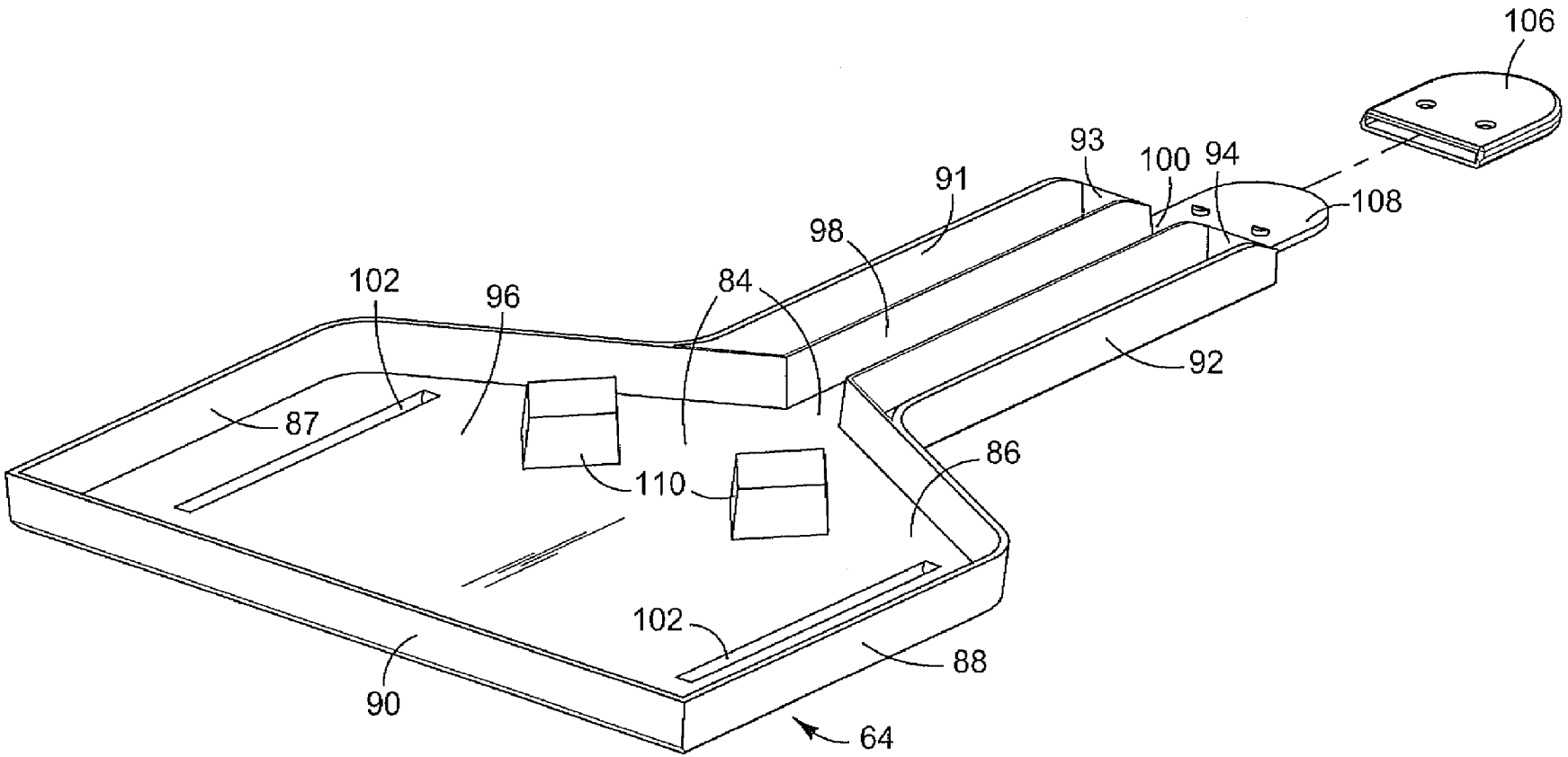
FIG. 8 is a detailed exploded view of the drawer in the assembly of FIGS. 3-6.

FIGS. 3-6 are perspective views of a debris receiver assembly 60 such as might be used in cabinets 10 and 32 of FIGS. 1 and 2. FIG. 7 is a detailed exploded view showing the drawer receptacle and cover from the assembly of FIGS. 3-6. FIG. 8 is a detailed exploded view of the drawer from the assembly of FIGS. 3-6. Referring to FIGS. 3-8, receiver assembly 60 includes a drawer receptacle 62, a debris receiving drawer 64 that slides in receptacle 62 and a cover 66 attached to receptacle 62. Receptacle 62 forms a generally Y-shaped bay 68 defined by a floor 70, cover/ceiling 66, sidewalls 71 and 72, and a rear end wall 73. An opening 74 in floor 70 at the rear of bay 68 forms a suction port 76 (see FIG. 4) that may be connected to ducting in a vacuum system. In the embodiment shown, as best seen in FIGS. 4 and 7, suction port 76 is configured as a stepped cylinder projecting down from floor 70 for connection to round tubular ducting. Of course, other configurations for suction port 76 are possible.

As also seen in FIGS. 4 and 7, cover 66 conforms to the uppermost planar shape of receptacle 62. Cover 66 is attached to a flange 78 along sidewalls 72 of receptacle 62 with screws 80. A groove 82 may be formed along flange 78 as shown in FIG. 7 to contain a gasket, including a ridge on the underside of cover 66 (not shown), to help seal cover 66 to receptacle 62. Other suitable fasteners or attachment techniques and seals may be used. Cover 66 could also be formed as an integral part of receptacle 62 rather than using the two discrete parts shown in the figures. As best seen in FIGS. 4 and 7, an electrical on-off switch 83 is located at the rear of receptacle 62 near the front of suction port 76. Switch 83 is mounted into a small forward facing wall 85 formed at the rear of receptacle 62. Other locations for switch 83 are, of course, also possible.

Figure 6:
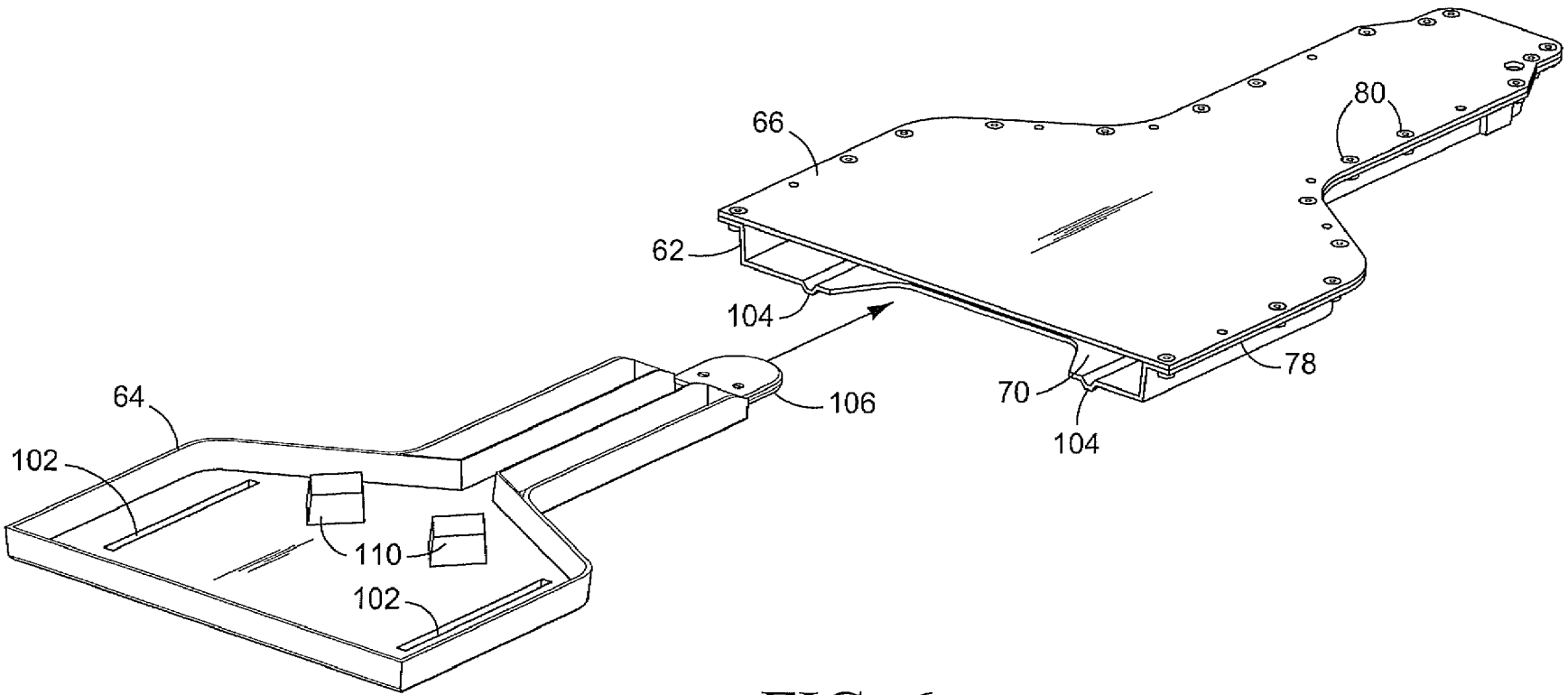

Referring now to FIGS. 6 and 8, drawer 64 forms a generally Y-shaped chamber 84 defined by a floor 86, sidewalls 87 and 88, and a front end wall 90 that extends across the front of drawer 64 between sidewalls 87 and 88. As best seen in FIG. 6, the outer shape of drawer 64 conforms closely to the inner shape of receptacle 62 so that drawer 64 nests inside receptacle 62 fully under cover 66 when drawer 64 is closed. In the embodiment shown, outer perimeter sidewalls 91 and 92, which extend parallel to chamber sidewalls 87 and 88 along the stem of the Y, form the outer perimeter of drawer 64 along this rear portion. Short rear end walls 93, 94 extend between sidewalls 87, 91 and 88, 92 at the rear of drawer 64. Outer perimeter sidewalls 91 and 92 strengthen chamber sidewalls 87 and 88 and rear end walls 93 and 94. One of the rear end walls 93 or 94 is used as a stop at the back of drawer 64 to activate switch 83 (see FIG. 7) to the off position when drawer 64 is closed. For switch 83 located at the rear right of receptacle 62, as shown in FIG. 7, rear end wall 94 is used as the stop.

Referring again to FIG. 8, the more broad forward part of drawer chamber 84 forms a basin 96 into which debris is swept when drawer 64 is open. The more narrow rearward part of chamber 84 forms a channel 98 through which debris is channeled from basin 96 to an outlet 100 at the rear of drawer 64. Air flowing through chamber 84 accelerates as it moves from the broad forward part through the gradually constricting sidewalls 87, 88 into the narrow channel 98 to help move debris toward suction port 76 (see FIG. 4). The tapered sidewalls 87, 88 of the Y-shaped chamber 84 also eliminate deep corners to help debris along the sidewalls move more easily from basin 96 into channel 98. In addition, as drawer 64 closes and suction is applied to an ever diminishing supply of air, the vacuum effect in chamber 84 is greatly increased, making it virtually impossible for any debris to remain in drawer 64 after it is closed.

Referring still to FIG. 8, a pair of rails 102 formed along the floor 86 of drawer 64 slide in tracks 104 formed in the floor 70 of receptacle 62 (see FIG. 7) to help keep drawer 64 properly aligned in receptacle 62. A rubber sleeve 106 fitted onto a tongue 108 extending from the rear of drawer 64 closes suction port 76 (see FIG. 4) when drawer 64 is closed. Sleeve 106 functions as a valve that starts and stops the flow of air through chamber 84. When drawer 64 is closed, sleeve 106 closes port 76 and, when suction is supplied to port 76, seals suction port 76 so that air will not flow through chamber 84. A pair of blocks 110 positioned on either side of channel 98 may be used in drawer 64 as necessary or desirable to reduce air volume in basin 96 and thereby accelerate the speed of air passing through basin 96.

Figure 9:
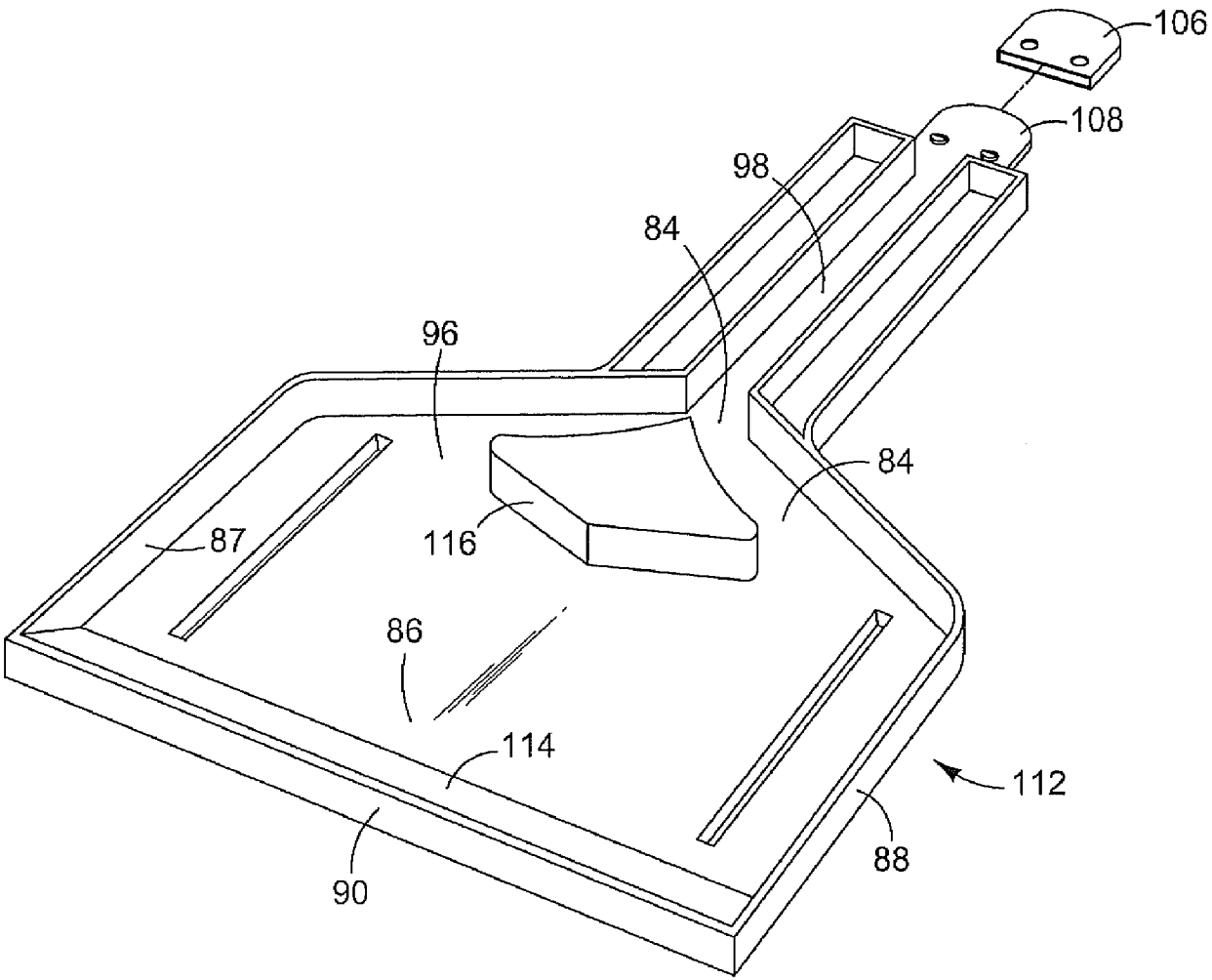
FIG. 9 is another embodiment of a drawer that may be used in the assembly of FIGS. 3-6.

FIG. 9 illustrates another embodiment of a drawer 112 that might be used in a receiver assembly such as the one shown in FIGS. 3-6. Referring to FIG. 9, drawer 112 is substantially the same as drawer 64 shown in FIG. 8 except that drawer 112 includes a ramp 114 providing a sloped transition from front end wall 90 down to floor 86, with a hollowed-out area on the underside (not shown) for use as a finger catch to open the drawer, and a single block 116 positioned in front of channel 98 to reduce air volume and accelerate the speed of air passing through basin 96. The front and rear of block 116 are tapered to help direct debris around block 116 and then in to channel 98.

Figure 10:
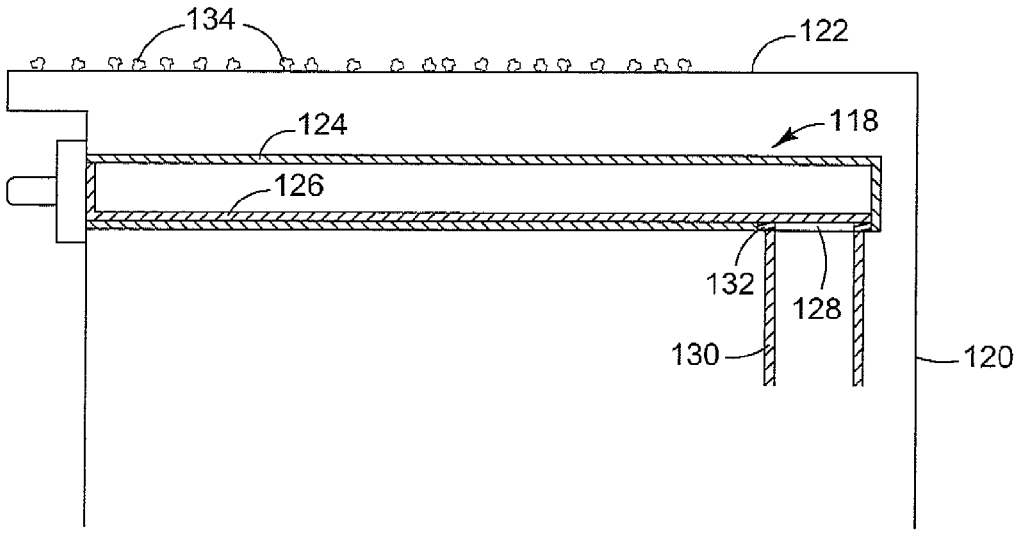
FIGS. 10 and 11 are section views that illustrate collecting debris off a countertop using an embodiment of the invention.
Figure 11:
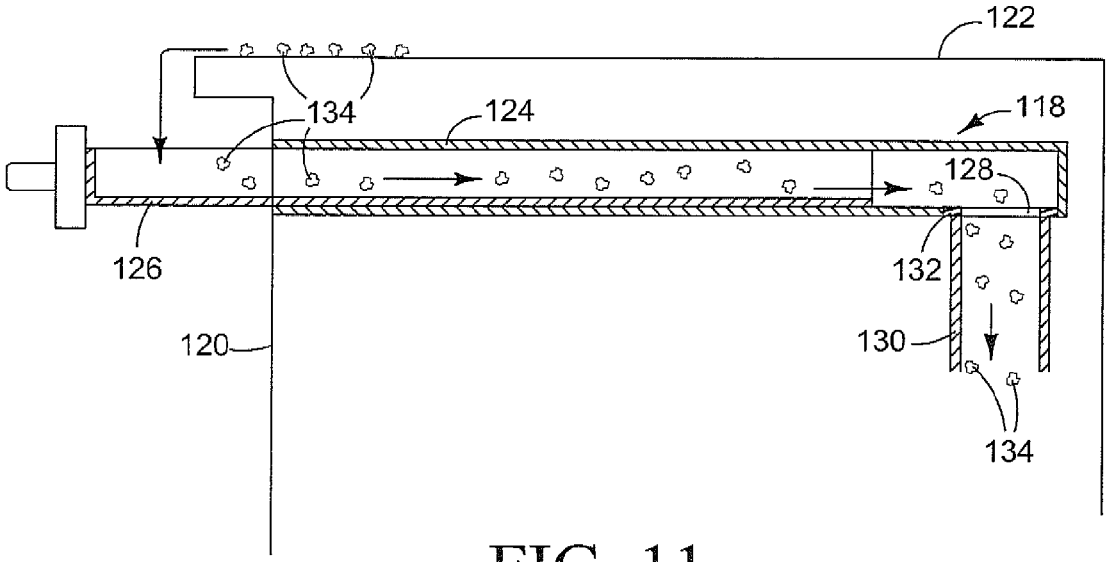

FIGS. 10 and 11 are section views that illustrate collecting debris off a countertop using an embodiment of the invention. Referring to FIGS. 10 and 11, a debris receiver assembly 118 is installed in a cabinet 120 having a countertop 122. Assembly 118 is positioned just below countertop 122. Receiver assembly 118 includes a drawer receptacle 124 and a debris receiving drawer 126 that slides in receptacle 124. A suction port 128 at the rear of receptacle 124 allows air to flow into vacuum duct 130. In this embodiment, a seal 132 is embedded in the floor of receptacle 124 surrounding suction port 128. When drawer 126 is closed (see FIG. 10) and suction is supplied to suction port 128, the floor of drawer 126 seals against seal 132 to prevent the flow of air through port 128 into duct 130. When drawer 126 is open (see FIG. 11), debris 134 falling into drawer 126 is immediately sucked back through suction port 128 into duct 130 and on to the collector in the central vacuum system.

Suction acting on particles of debris 134 as they fall into drawer 126 and before the particles hit the floor of drawer 126 helps minimize the drag that must be overcome to move particles toward suction port 128. Also, after debris 134 is swept into drawer 126 and drawer 126 starts to close, the suction applied to the particles of debris 134 greatly increases to help ensure all debris 134 in drawer 126 is sucked into duct 130. While air flow rates may vary depending on the suction produced by the vacuum pump, the size of the duct/suction port, the size of the channel opening to the drawer, and the "efficiency" of the receiver assembly, it is expected that a typical residential vacuum pump producing 350-1,000 air-watts at the pump will generate adequate flow through the debris receiver drawer if the ratio between the exposed area of the open drawer and the area of the duct/suction port is in the range of 14:1-92:1. For example, in a drawer 126 that is nominally 1 inch deep, 11 inches across chamber basin 96 tapering to a 1 inch wide channel 98 (basin 96 and channel 98 are shown in FIGS. 8 and 9), and opening a maximum of 6 inches along parallel sidewalls, the ratio between the exposed area of the fully open drawer 126 and a 1 inch diameter suction port 128 is 84:1. At this ratio, the suction from a typical residential vacuum pump is expected to suck air into the 1 inch diameter suction port 128 through drawer basin 96 at the rate of at least 1,000 feet per minute. This flow rate increases as the ratio between the area of the open drawer and the area of the suction port decreases (for the same drawer depth). As drawer 126 nears full closure, air is sucked through basin 96 at more than 10,000 feet per minute. Even if these flow rates are reduced by 30% to account for air leaking into drawer 126 (reflecting a 70% air leak "efficiency" for receiver assembly 118), the actual flow rates are still expected to be adequate to suck debris through drawer 126 and into suction port 128.

Figure 12:
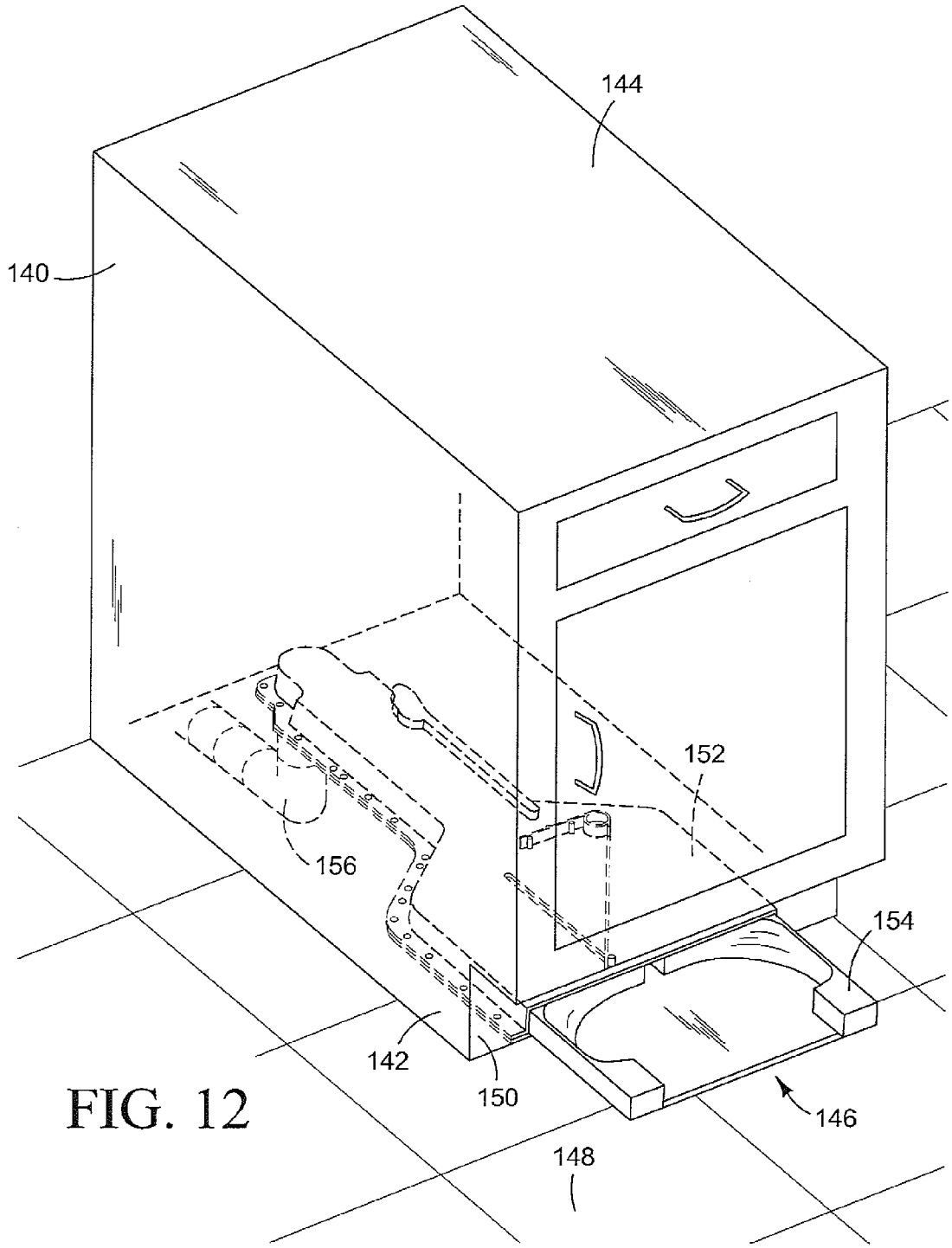
FIG. 12 illustrates a cabinet according to an embodiment of the invention for receiving debris off the floor.

FIG. 12 illustrates another embodiment of a cabinet 140 such as might be utilized at various locations in a home or business. Referring to FIG. 12, cabinet 140 includes a base 142, a countertop 144 on base 142, and a debris receiver assembly 146 mounted at the level of floor 148 in a toe kick recess 150 in base 142. Receiver assembly 146 includes a drawer receptacle 152 fixed in base 142 or to floor 148 and a debris receiving drawer 154 that slides in receptacle 152. A duct 156 runs from a suction port at the back of assembly 146 to a central vacuum. As described in more detail below, a seal is positioned in the floor of drawer 154 to close and seal the suction port when drawer 154 is closed and suction is supplied to the port. Hence, when drawer 154 is closed, the central vacuum can suck air in through other suction ports, if any, in the central vacuum system. An electrical switch is used to automatically turn on the central vacuum when drawer 154 is opened and to automatically turn off the central vacuum when drawer 154 is closed.

Figure 13:
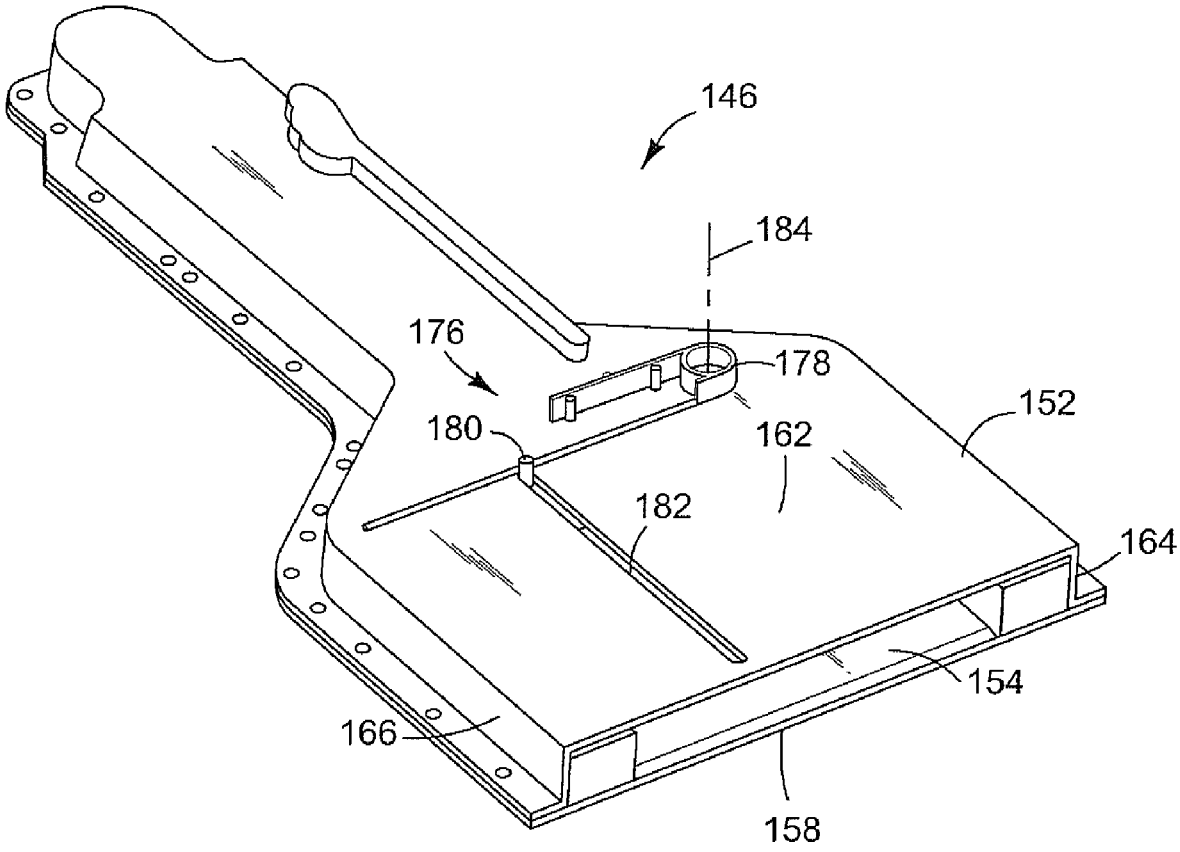
FIGS. 13-15 are perspective views looking down on the top of a debris receiver assembly according to another embodiment of the invention.
Figure 14:
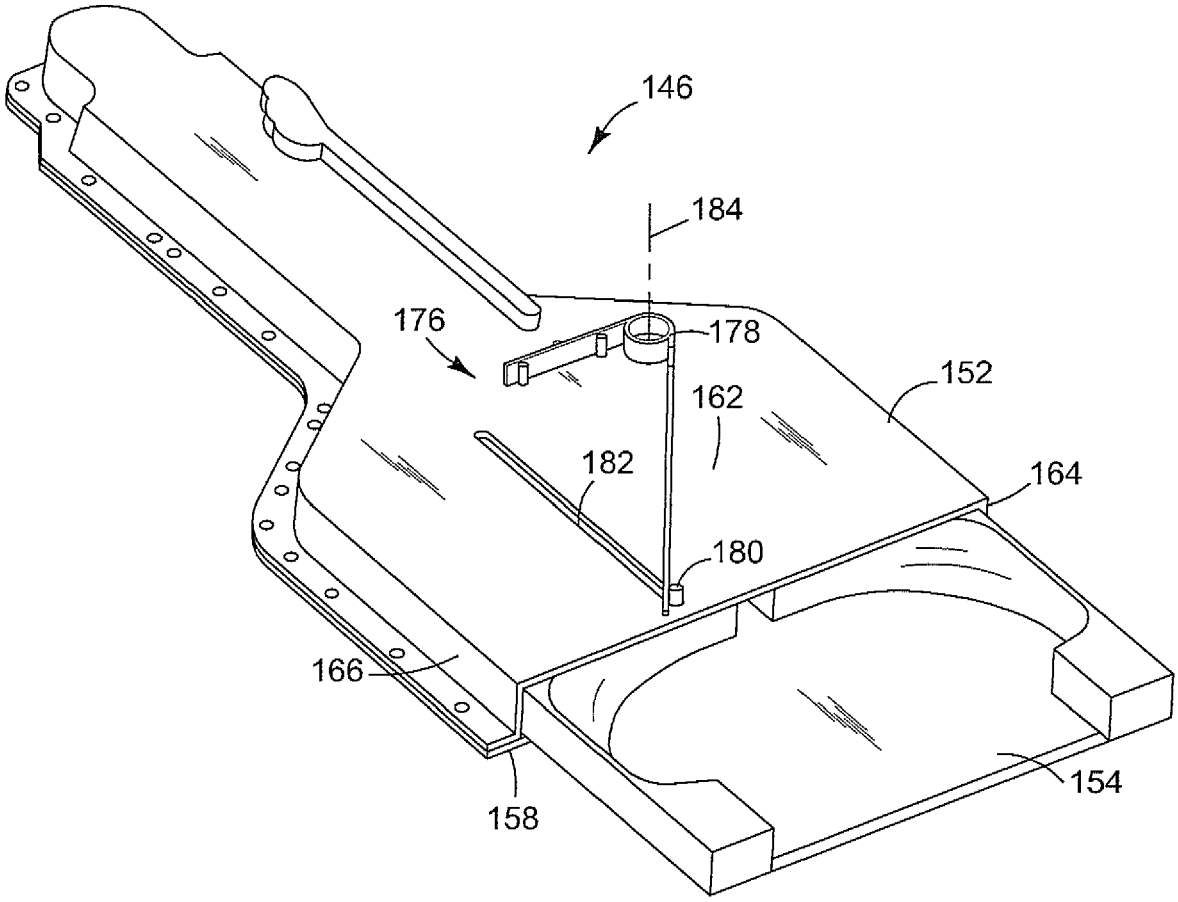
Figure 15:
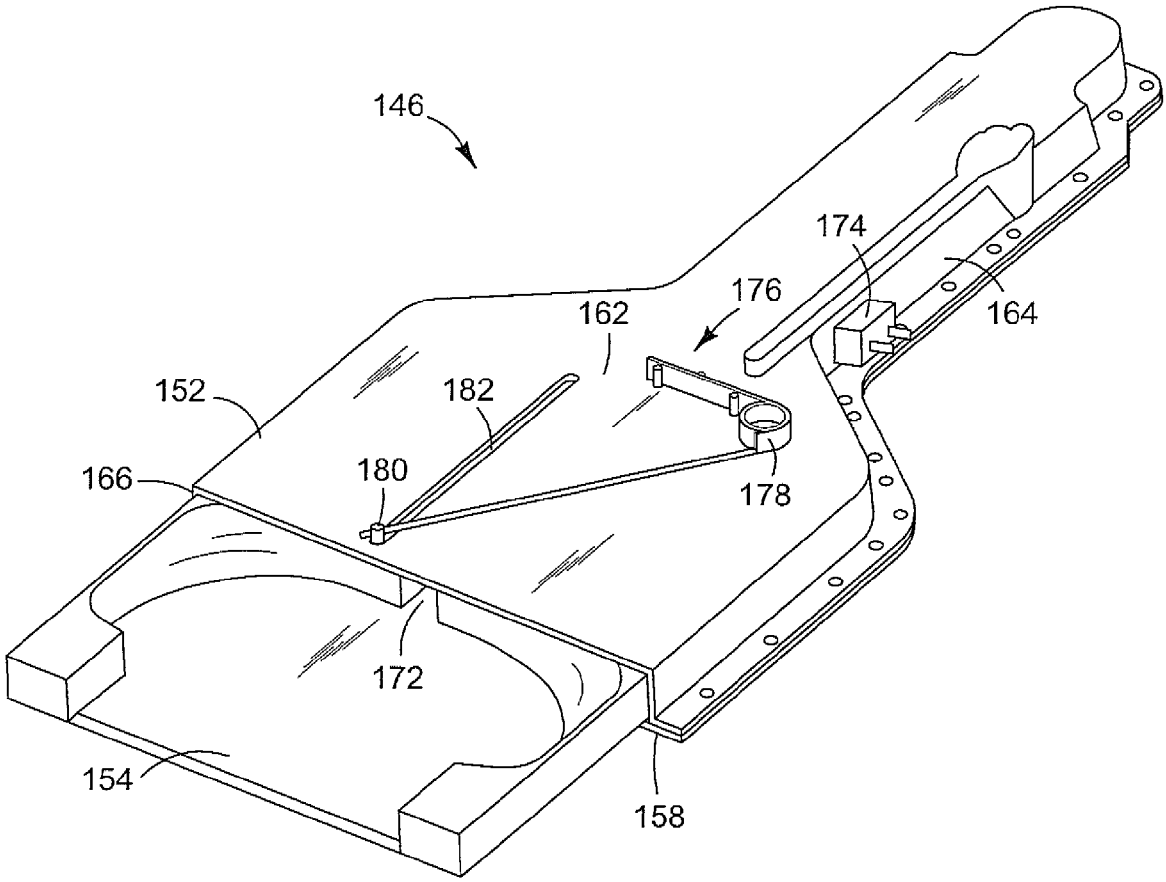
Figure 16:
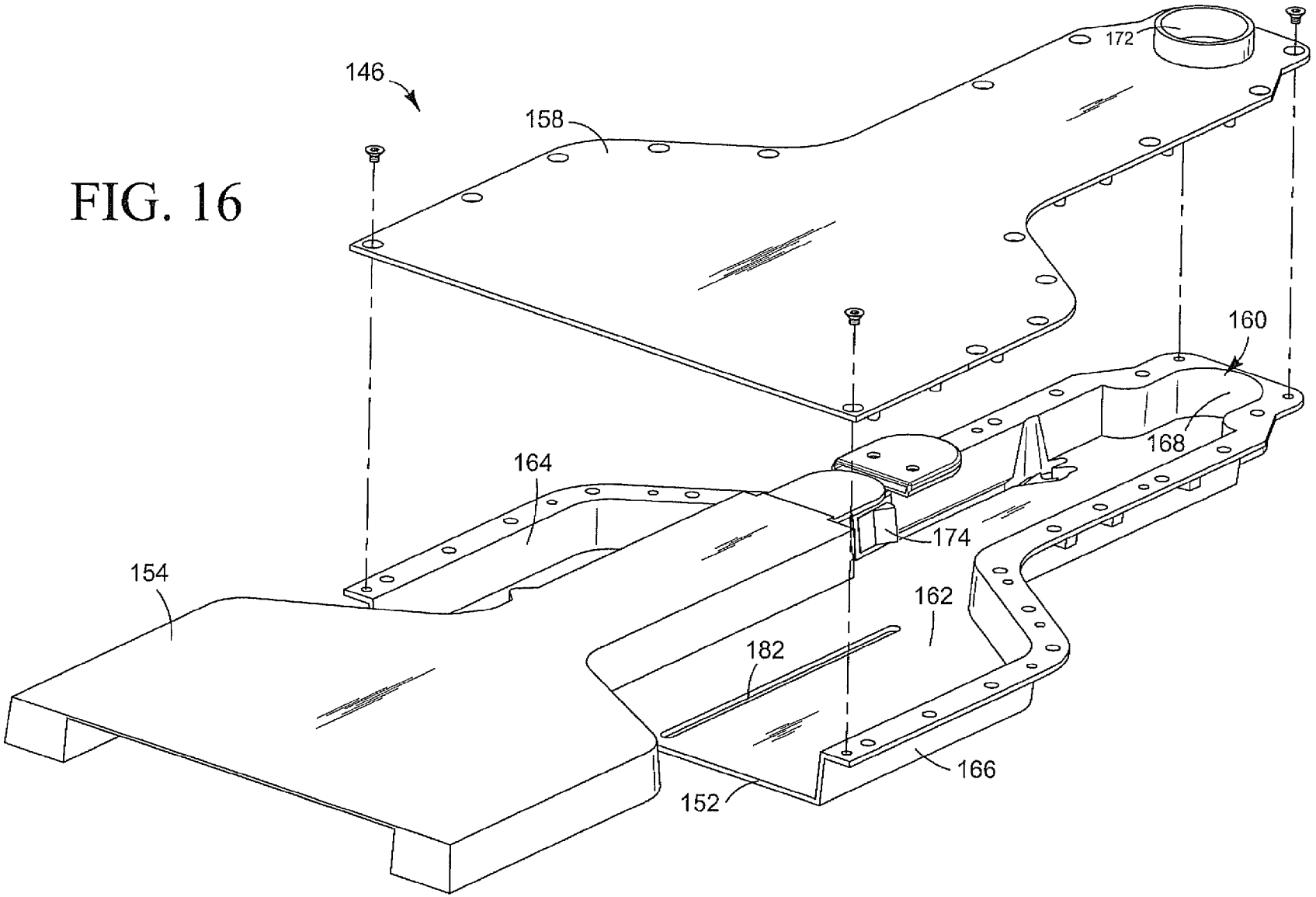
FIG. 16 is a detailed exploded view of the assembly of FIGS. 13-15. In the perspective view of FIG. 16, the assembly is flipped over so that it is viewed looking down onto the bottom of the assembly to better illustrate features of this embodiment.

FIGS. 13-15 are perspective views of debris receiver assembly 146. FIG. 16 is a detailed exploded view of assembly 146. In the perspective view of FIG. 16, assembly 146 is flipped over so that it is viewed looking down onto the bottom of assembly 146. Referring to FIGS. 13-16, receiver assembly 146 includes receptacle 152, drawer 154 that slides in receptacle 152 and a base plate 158 (FIG. 16) attached to receptacle 152. As shown in FIG. 16, base plate 158 covers the bottom of receptacle 152 and drawer 154. Receptacle 152 forms a generally Y-shaped bay 160 defined by a ceiling 162, floor/base plate 158, sidewalls 164 and 166, and a rear end wall 168. Base plate 158 is attached to a flange along sidewalls 164, 166 of receptacle 152 with screws or another suitable fastener. Base plate 158 could also be formed as an integral part of receptacle 152 rather than using the two discrete parts shown in the figures.

An opening in floor 158 at the rear of bay 160 forms a suction port 172 that may be connected to ducting in a vacuum system. Suction port 172 represents generally any suitable opening in assembly 146 that allows suction supplied by the central vacuum (through duct 156 in FIG. 12, for example) to reach drawer 154 when drawer 154 is open. In the embodiment shown, suction port 172 is configured as a cylinder projecting down from floor 158 for connection to round tubular ducting. Other configurations for suction port 172 are possible. If floor/base plate 158 is omitted, and receptacle 152 mounted directly to the bottom of a cabinet or directly to the room floor, then suction port 172 may be formed in the bottom of the cabinet or in the floor.

An electrical on-off switch 174 is located in sidewall 164 of receptacle 152. Switch 174 is used to automatically turn on the central vacuum when drawer 154 is opened and to automatically turn off the central vacuum when drawer 154 is closed. The operation of a rocker switch 174 is described in more detail below with reference to FIGS. 19 and 20. Rocker switch 174 is just one example of a suitable electrical on-off switch. A biasing mechanism 176 operatively connected between receptacle 152 and drawer 154 continually urges drawer 154 toward an open position when drawer 154 is not fully open. In the embodiment shown, which is just one example of a suitable biasing mechanism, biasing mechanism 176 includes a coil type biasing spring 178 mounted to receptacle ceiling 162 acting on drawer 154 through a follower/pin 180 that projects up through a slot 182 in receptacle ceiling 162. When drawer 154 is in the closed position shown in FIG. 13, pin 180 is at a lesser distance from the axis 184 about which spring 178 coils and uncoils and, accordingly, spring 178 is in a more coiled position exerting a greater opening force on drawer 154 through pin 180. When drawer 154 is in the fully open position shown in FIGS. 14 and 15, pin 180 is at a greater distance from spring coiling axis 184 and, accordingly, spring 178 is in a less coiled position exerting a lesser opening force on drawer 154 through pin 180.

Figure 17:
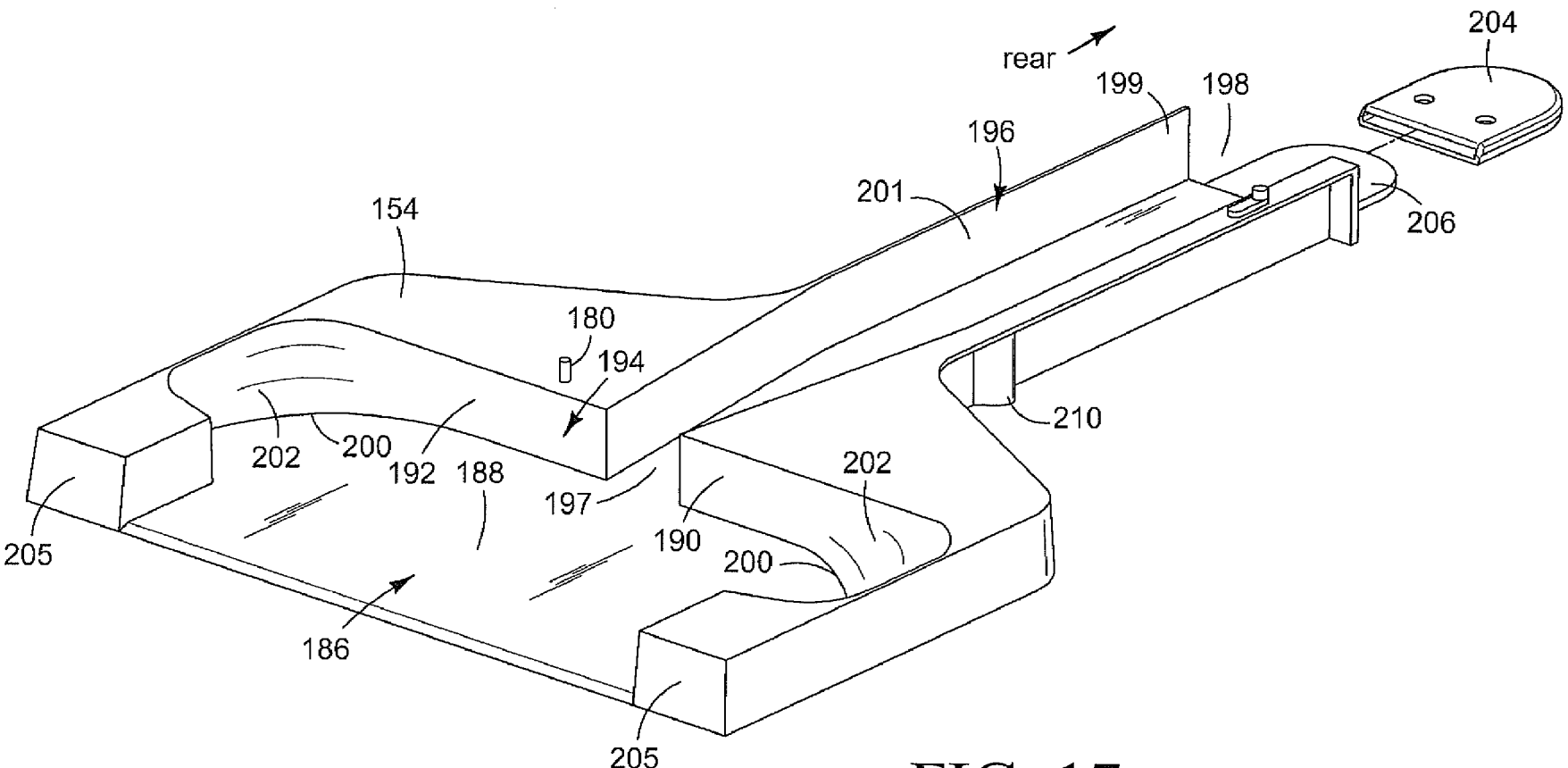
FIG. 17 is a detailed exploded view of the drawer in the assembly of FIGS. 13-16.
Figure 18:
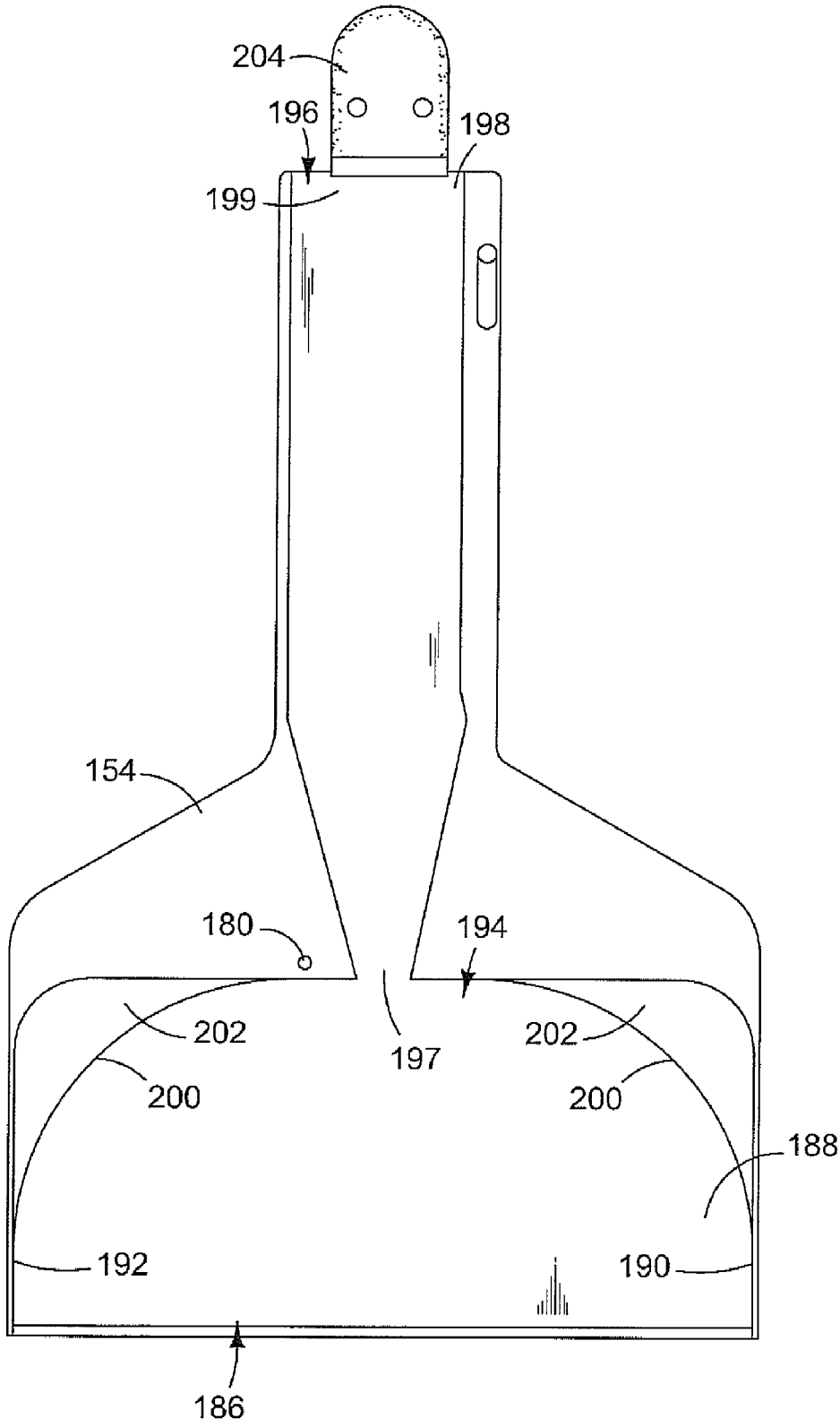
FIG. 18 is a top plan view of the drawer in the assembly of FIGS. 13-16.

Referring now to FIGS. 17 and 18, drawer 154 forms a generally Y-shaped chamber 186 defined by a floor 188 and sidewalls 190 and 192. The outer shape of drawer 154 conforms to the inner shape of receptacle 152 so that drawer 154 nests inside receptacle 152 (see FIG. 16) when drawer 154 is closed. The more broad forward part of drawer chamber 186 along the legs of the Y forms a basin 194 into which debris may be swept when drawer 154 is open. The more narrow rearward part of chamber 186 along the stem of the Y forms a channel 196 through which debris is channeled from basin 194 to an outlet 198 at the rear of drawer 154. Sidewalls 190 and 192 taper along channel 196 from a more narrow part 197 at basin 194 to a more broad part 199 that extends to outlet 198 in order to maximize the speed of the air flowing through more narrow part 197. Sidewalls 190 and 192 are contoured at each of two rounded corners 200 along the legs of the Y. The contoured surface 202 at each corner 200 slopes up from floor 188 and narrows in each direction moving away from the center of the corner 200 until sloping surface 202 transitions into a substantially vertical sidewall. Contoured surfaces 202 help minimize the exposure of flat areas on the top of drawer 154 onto which debris might otherwise be swept when drawer 154 is open.

A sleeve 204 fitted onto a tongue 206 extending from the rear of drawer 154 closes suction port 172 (FIG. 16) when drawer 154 is closed. Sleeve 204 functions as a valve that starts and stops the flow of air through chamber 186. When drawer 154 is closed, sleeve 204 closes port 172 and, when suction is supplied to port 172, seals suction port 172 so that air will not flow through chamber 186. A push block 205 may be formed at one or both sides of the front of drawer 154 to facilitate a user pushing on drawer 154 with his foot to open and close drawer 154.

Figure 19:
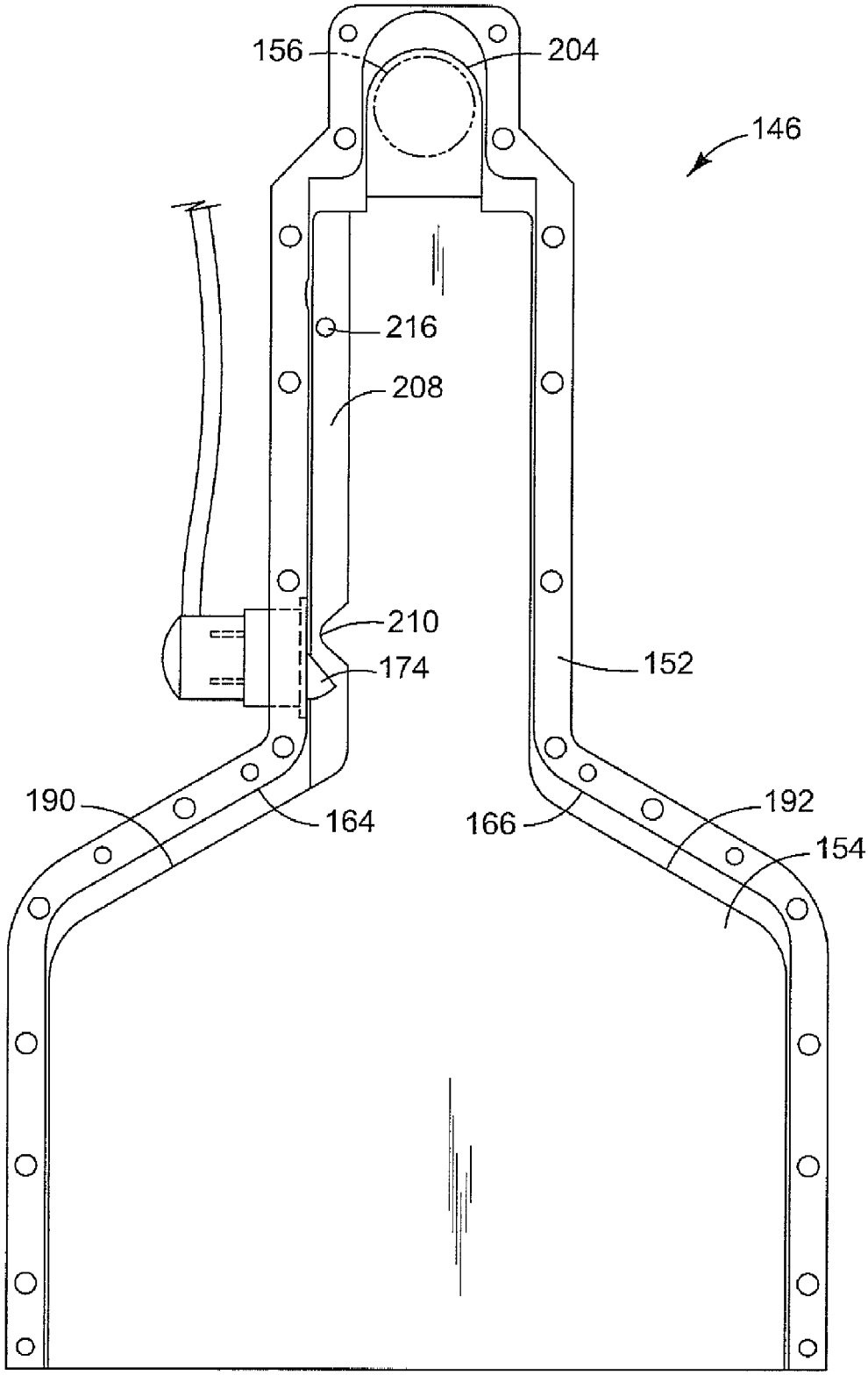
FIGS. 19-20 are bottom plan views of the assembly of FIGS. 13-16 showing operation of the rocker switch.
Figure 20:
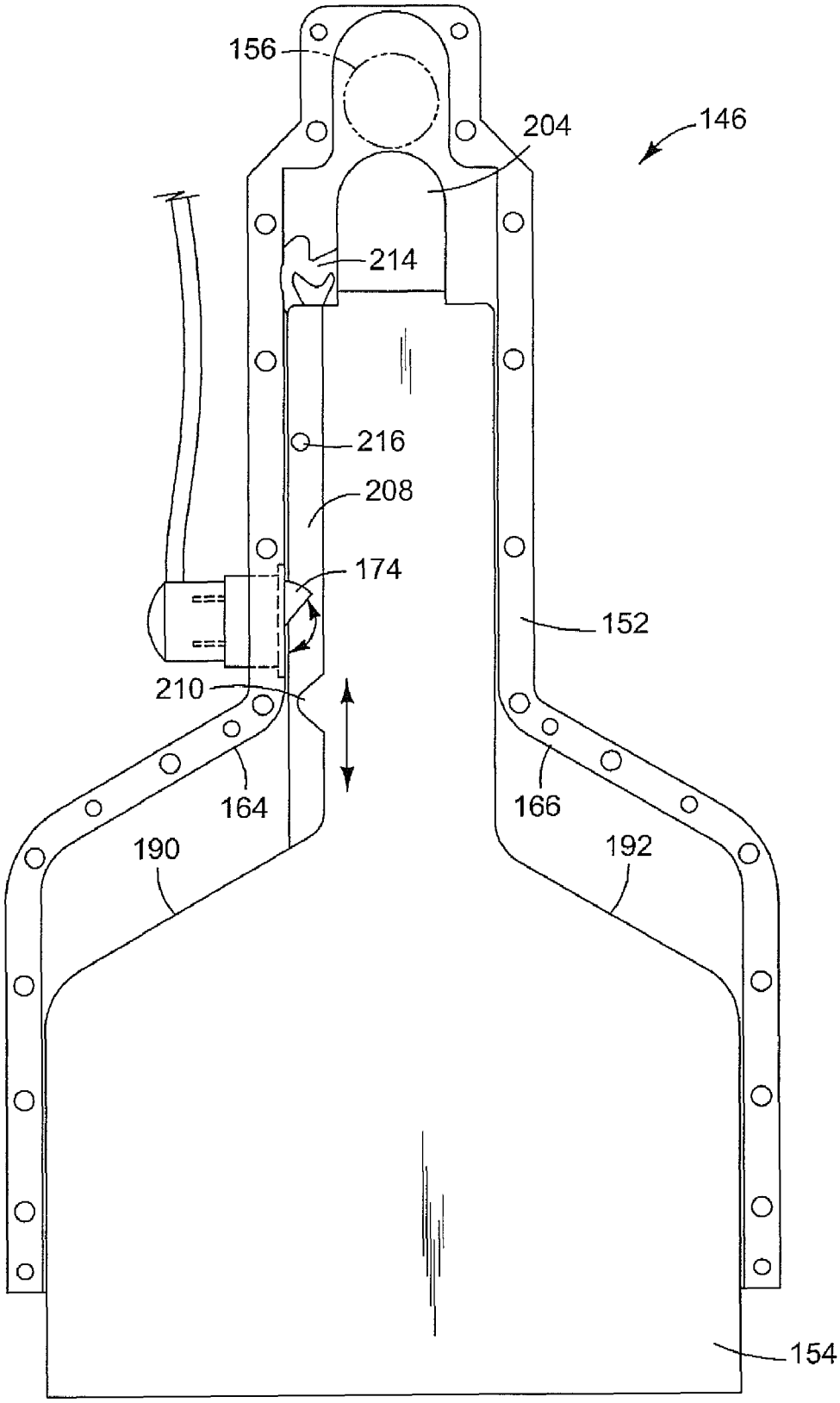

FIGS. 19 and 20 illustrate the operation of on-off rocker switch 174. FIGS. 19 and 20 are plan views looking up at the bottom of debris receiver assembly 146 with base plate 158 (FIG. 16) removed to show receptacle 152 and drawer 154. Referring to FIGS. 19 and 20, rocker switch 174 is mounted nearly flush to the interior of receptacle sidewall 164. The channel region of drawer 154 is positioned in the channel region of receptacle 152 by drawer sidewall 192 on one side and by a flange 208 that extends out from drawer sidewall 190 on the other side. A lobe 210 on sidewall 190 under flange 208 drives the rocker switch back and forth (on and off) as drawer 154 opens and closes, as best seen by comparing FIGS. 19 and 20. (Lobe 210 is also shown in FIG. 17.) The relative positions of lobe 210 along drawer sidewall 190 and switch 174 along receptacle sidewall 164 may be adjusted to turn the vacuum source on and off with switch 174 at the desired position of drawer 154. For example, in the configuration shown in FIGS. 19 and 20, switch 174 is rocked to the on position to turn on the vacuum as suction port 172 (FIG. 16) begins to open and, accordingly, switch 174 is rocked to the off position to turn of the vacuum when suction port 172 is nearly closed.

FIGS. 21-27 illustrate the operation of a releasable catch 212 that holds drawer 154 in the closed position. FIGS. 21-27 are plan views looking up at the bottom of the channel end of debris receiver assembly 146 with base plate 158 (FIG. 16) removed to show receptacle 152 and drawer 154. Referring to FIGS. 21-27, catch 212 includes a groove 214 in receptacle ceiling 162, a pin 216 mounted to drawer flange 208, and a series of gates 218 and stops 220 at the head of groove 214. Groove 214 includes an elongated section 222 having substantially straight parallel sides that open into a bulbous head section 224 having curved sides at an upstream end of groove 214 that corresponds generally to the closed position of drawer 154. (Groove 214 is shown in FIGS. 13-15 looking down on to the top of receptacle ceiling 162.) Catch pin 216 is mounted to drawer flange 208 such that it can rotate in the bulbous groove head section 224 of groove 214 as described below. (Pin 216 mounted to flange 208 is also shown in FIGS. 17 and 18.) Pin 216 and groove 214 are positioned relative to one another such that pin 216 slides along groove 214 when drawer 154 is moved back and forth between closed and open positions.

Figure 21:
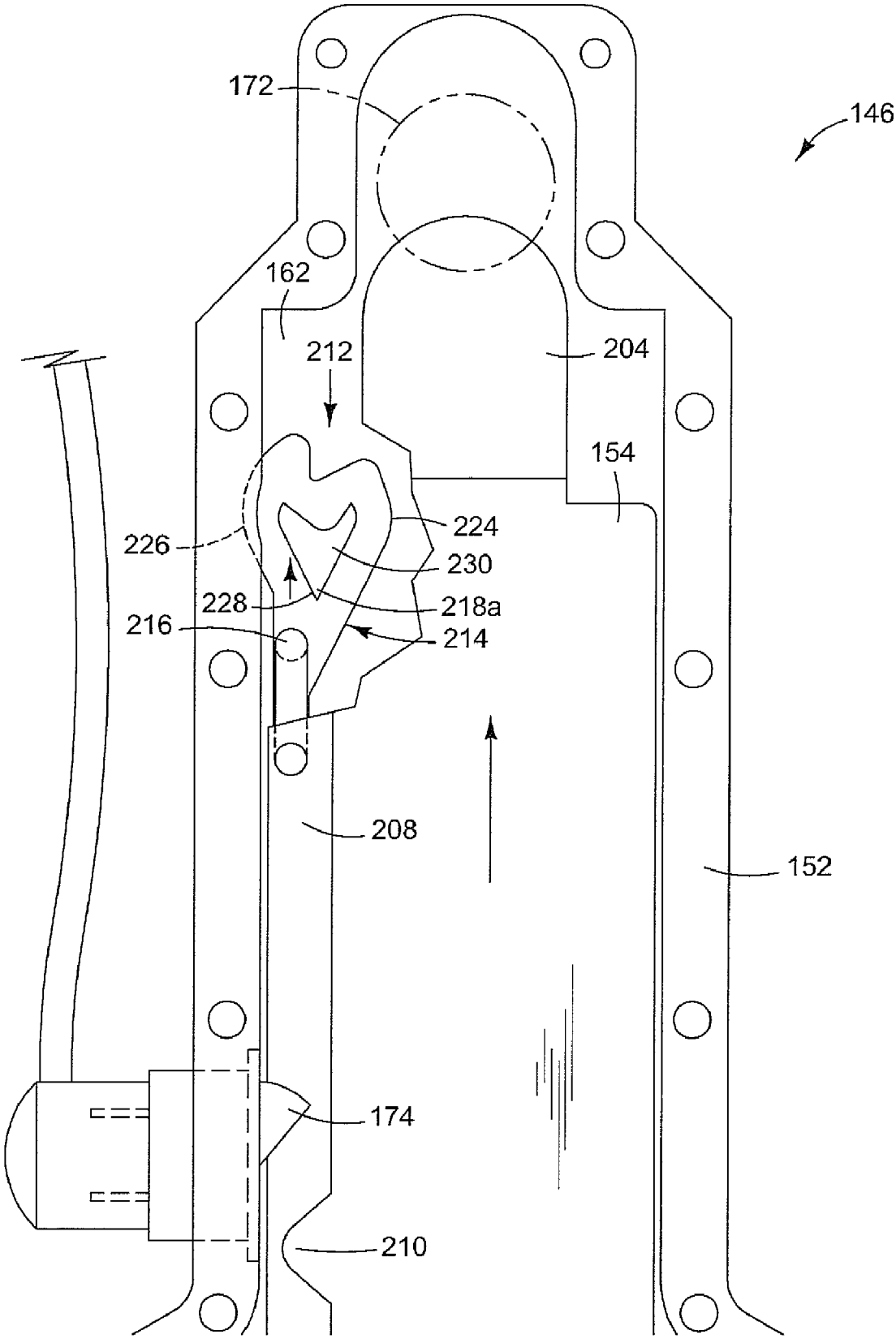
FIGS. 21-27 are close-up bottom plan views of a portion of the assembly over FIGS. 13-16 showing operation of the releasable catch that holds the drawer in the closed position.
Figure 22:
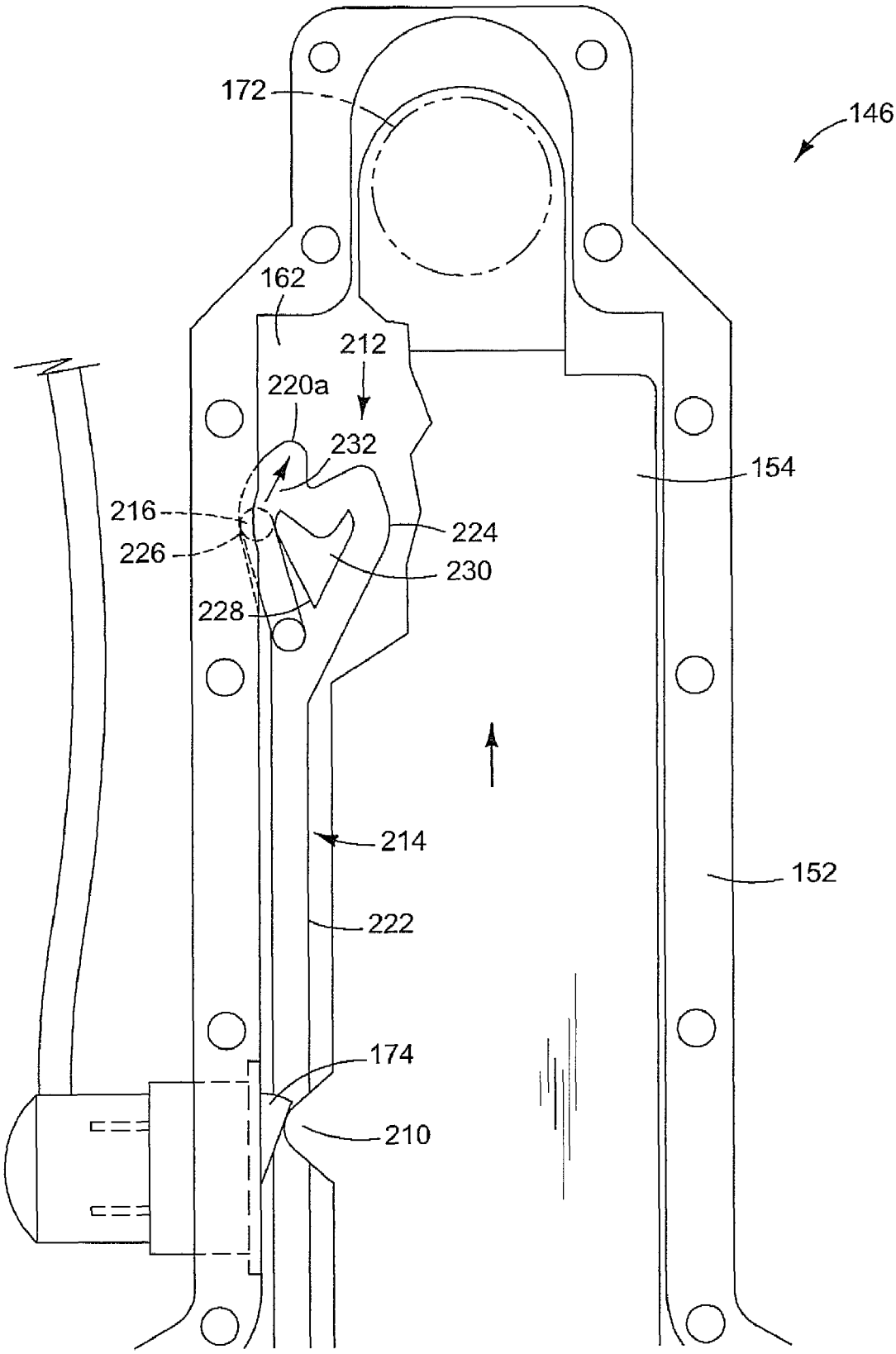
Figure 23:
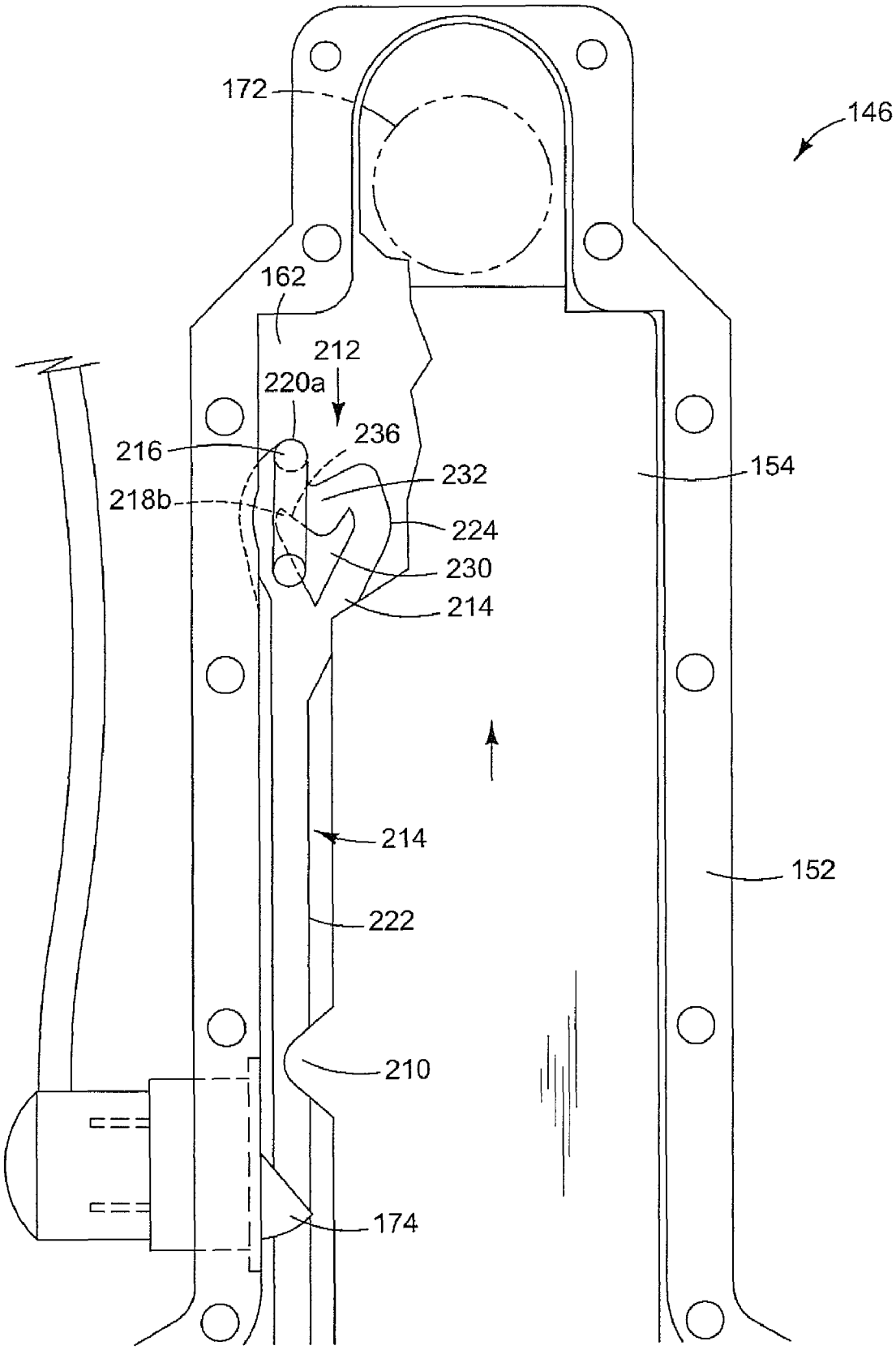
Figure 24:
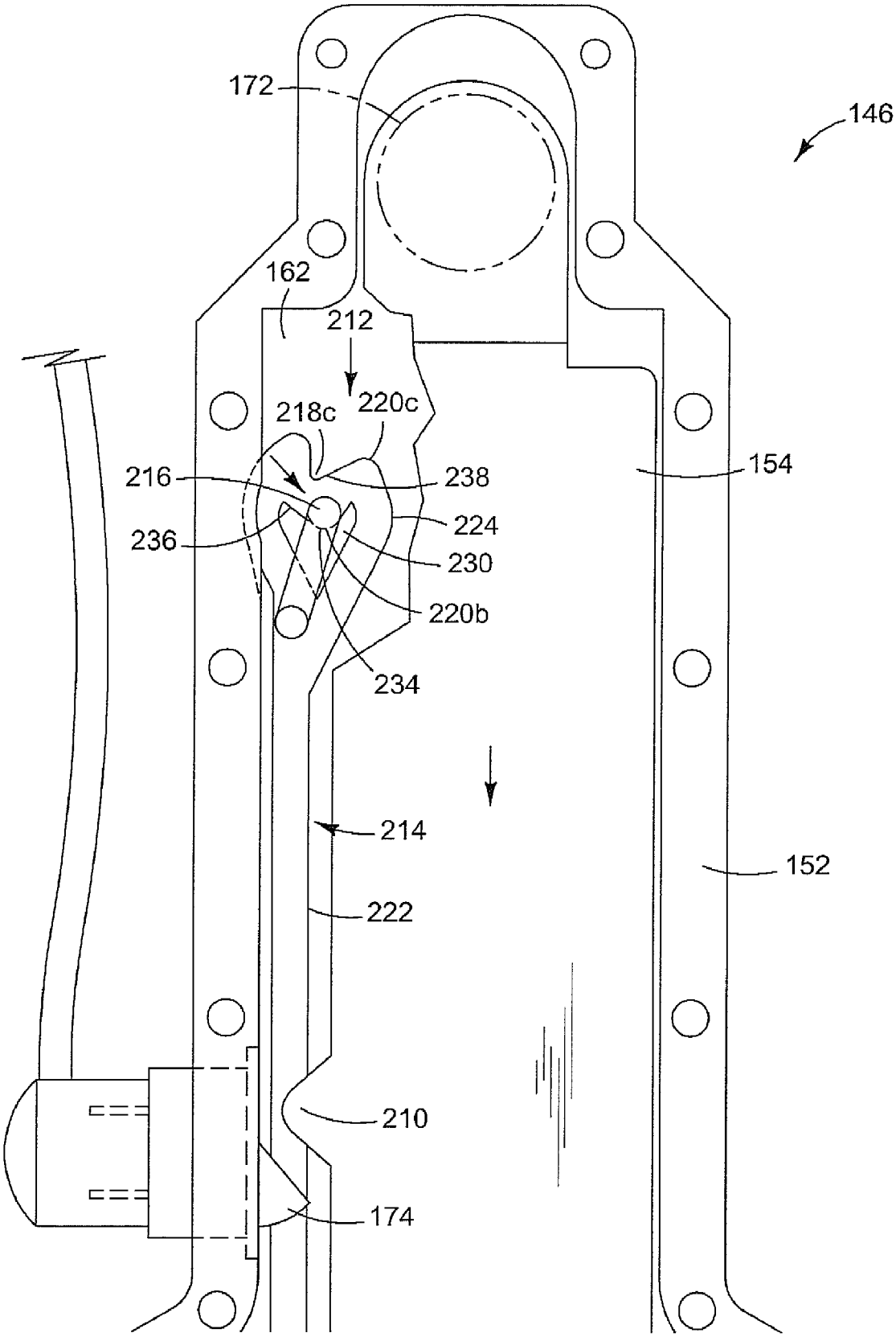
Figure 27:
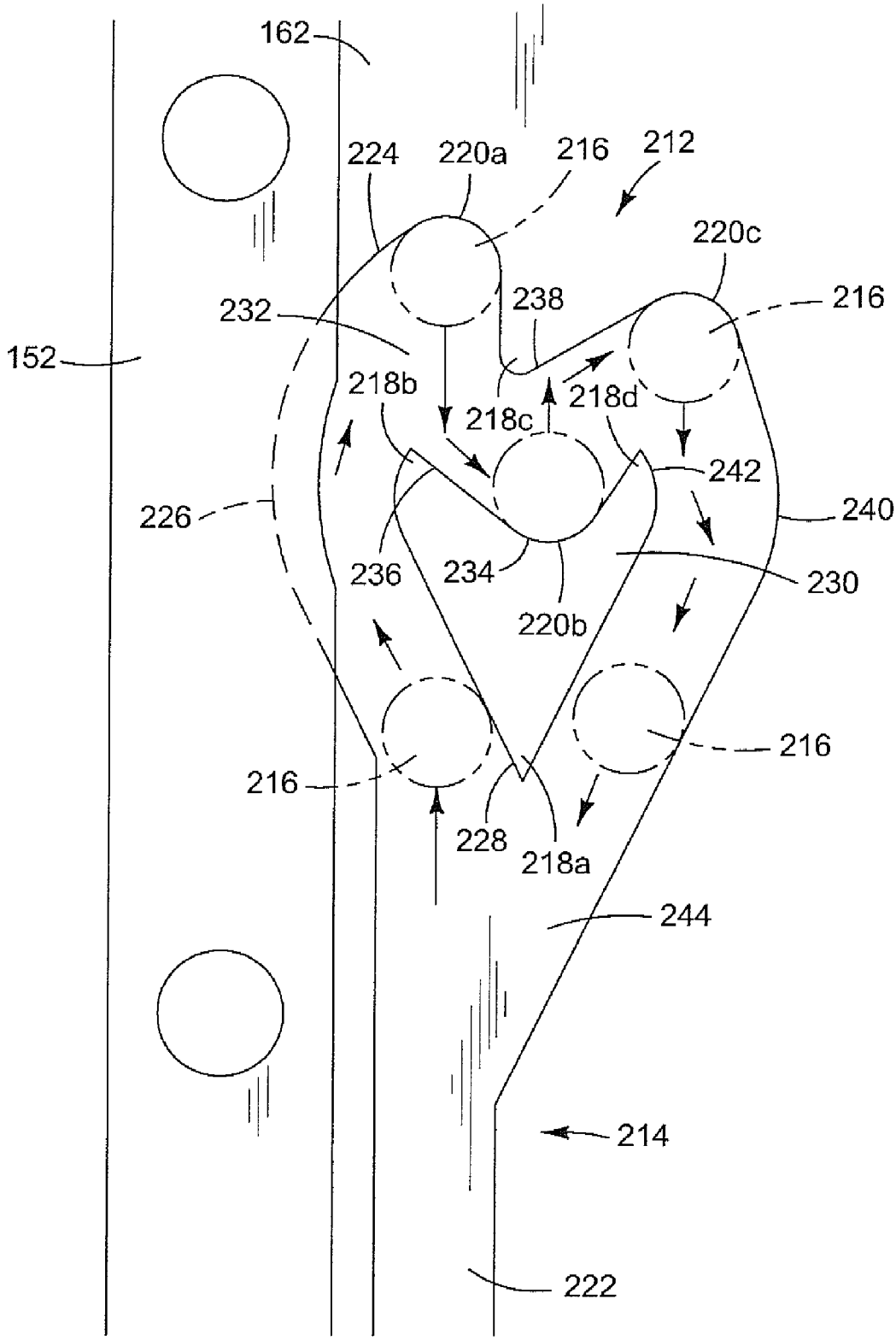

Referring to FIGS. 21-22 and 27, as drawer 154 is moved toward the closed position, pin 216 is guided along a curved outboard side 226 of groove head 224 by a first surface 228 that intersects groove 214 at the transition from straight section 222 and groove head section 224. First intersecting surface 228 is part of a generally heart shaped island 230 positioned in groove head 224. First intersecting surface 228 functions as a first gate 218*a*, to an inbound channel 232 around island 230. Referring now to FIGS. 23-24 and 27, as drawer 154 is moved in past the closed position, pin 216 reaches the end of groove 214 at a first stop 220*a*. When drawer 154 is released from this position at stop 220*a* and moves back toward an open position at the urging of biasing mechanism 176 (see FIGS. 13-15), pin 216 is guided down into a notch 234 formed in the upstream end of island 230 by a second intersecting surface 236. Second intersecting surface 236 functions as a second gate 218*b*, into notch 234. Notch 234 functions as a second stop 220*b*.

Figure 25:
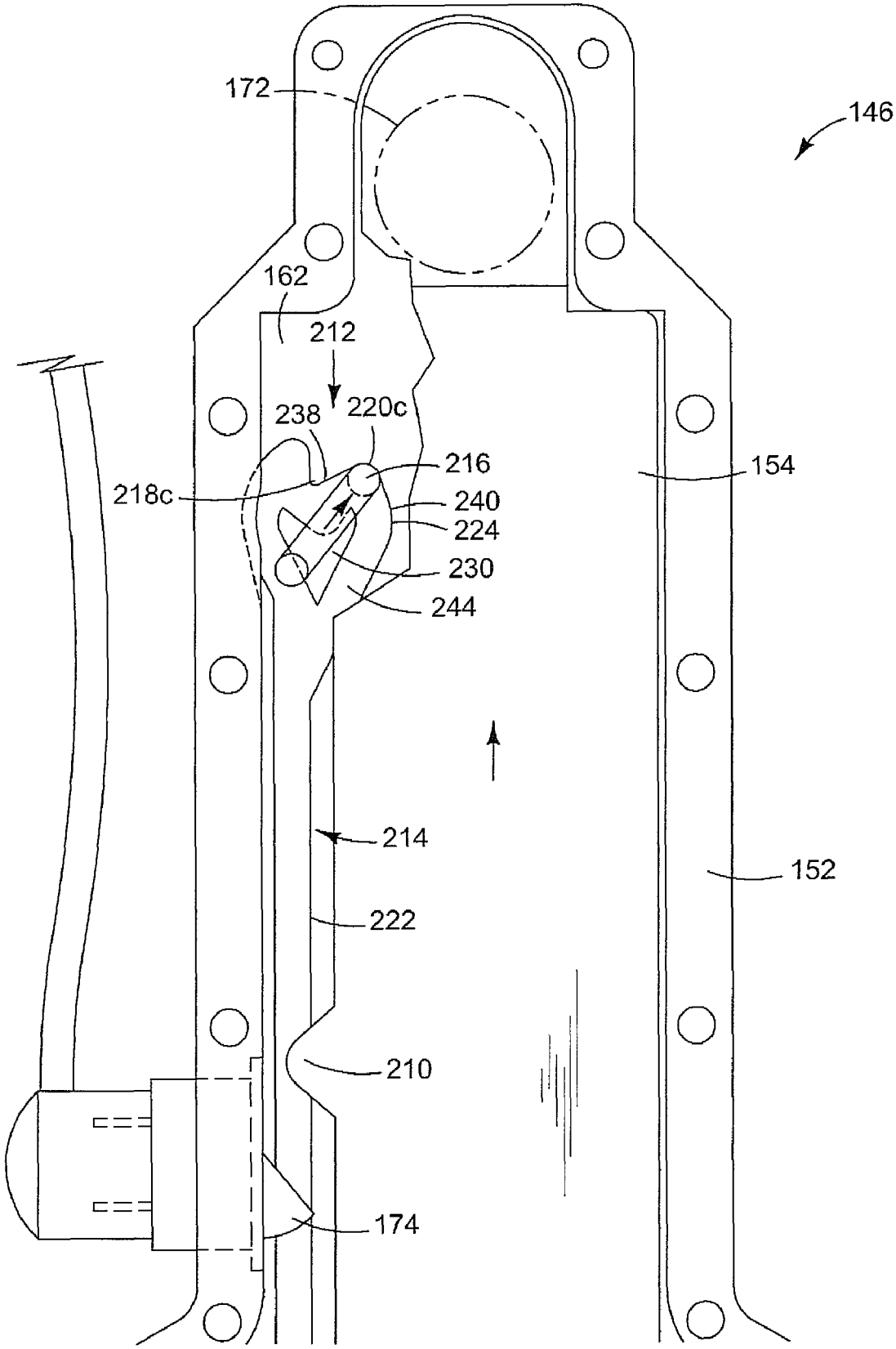
Figure 26:
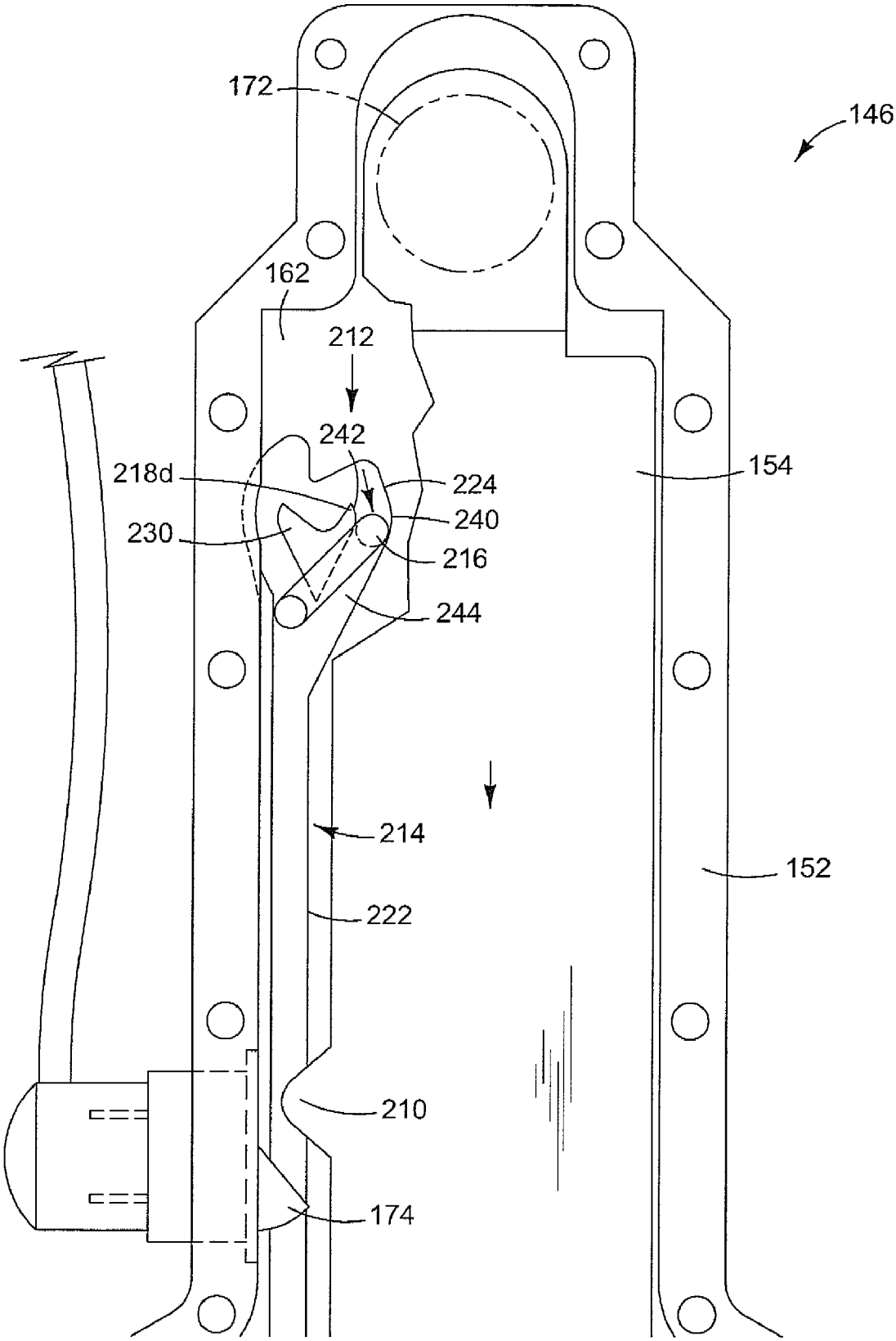

Drawer 54 is opened by pushing in on a closed drawer 154. Referring to FIGS. 25-26 and 27, as drawer 154 is pushed in past the closed position, pin 216 is guided to the end of groove 214 at a third stop 220*c* by a third intersecting surface 238. Third intersecting surface 238 functions as a third gate 218*c*, to stop 220*c*. When drawer 154 is then released and moves toward an open position at the urging of biasing mechanism 176, pin 216 is guided along a curved inboard side 240 of groove head 224 by a fourth intersecting surface 242 on island 230. Fourth intersecting surface 242 functions as a fourth gate 218*d* to an outbound channel 244 around island 230. Pin 216 is thereafter free to travel along groove straight section 222 as drawer 154 moves toward an open position.

The present invention has been shown and described with reference to the foregoing exemplary embodiments. Other embodiments are possible. For example, a debris receiver assembly may be used with or include a local vacuum (rather than a central vacuum) implemented as a stand-alone unit. For another example, floor and countertop debris receivers could be incorporated into the same cabinet or system. It is to be understood, therefore, that other configurations, embodiments, and implementations may be made without departing from the spirit and scope of the invention which is defined in the following claims. In accordance with the longstanding and well established principle of interpreting patent claims, the article "a" in the claims means one or more. For example, "a basin" in Claim 14 means one or more basins and the subsequent reference to "the basin" in Claim 14 means the one or more basins.

What is claimed is:

1. An assembly for receiving debris into a suction debris collection system, the assembly comprising:

a receptacle;

a drawer slideable in the receptacle between a single closed position and an open position, an exterior perimeter shape of the drawer conforming to an interior perimeter shape of the receptacle and the drawer including a floor and walls extending up from the floor, the floor and the walls defining a chamber through which air may pass to a suction port at a rear part of the receptacle when the drawer is in an open position and suction is supplied to the port;

a seal integral with the drawer and configured to seal the suction port when the drawer is in the closed position; and an electrical switch operable between an off position when the drawer is in the closed position and an on position when the drawer is in an open position.

2. The assembly of claim 1, wherein the receptacle covers the chamber when the drawer is in the closed position and the assembly further comprises a base plate attached to the receptacle along the floor of the drawer such that the drawer is substantially enclosed within the receptacle and the base plate when the drawer is in the closed position.

3. The assembly of claim 2, wherein the receptacle comprises a tray conforming substantially to a shape of the drawer.

4. The assembly of claim 2, wherein the base plate has an opening therein to the suction port, the opening located at a rear part of the base plate, and the seal comprises a seal configured to seal the opening in the base plate when the drawer is in the closed position.

5. The assembly of claim 1, further comprising a cover attached to the receptacle such that the chamber is fully covered by the cover when the drawer is in the closed position and the chamber is only partially covered by the cover when the drawer is in an open position.

6. The assembly of claim 5, wherein the receptacle comprises a tray conforming substantially to a shape of the drawer.

7. The assembly of claim 5, wherein the receptacle has an opening therein to the suction port, the opening located at a rear part of the receptacle, and the seal comprises a seal configured to seal the opening in the receptacle when the drawer is in the closed position.

8. The assembly of claim 1, wherein the switch comprises a rocker switch mounted to the receptacle such that moving the drawer from the closed position to an open position rocks the switch to the on position and moving the drawer from an open position to the closed position rocks the switch to the off position.

9. The assembly of claim 1, wherein the drawer is open across a front of the chamber.

10. The assembly of claim 9, wherein the drawer further includes a push block located along the front of the chamber.

11. The assembly of claim 1, wherein the drawer further includes a front end wall extending across a front of the chamber between forward ends of the sidewalls.

12. The assembly of claim 1, further comprising a releasable catch operatively connected between the receptacle and the drawer for holding the drawer in the closed position until the catch is released.

13. The assembly of claim 1, further comprising a biasing mechanism operatively connected between the receptacle and the drawer, the biasing mechanism configured to bias the drawer toward an open position.

14. An assembly for receiving debris into a suction debris collection system, the assembly comprising:

a receptacle;

a drawer slideable in a receptacle bay between a single closed position and an open position, an exterior perimeter shape of the drawer conforming to an interior perimeter shape of the receptacle, the drawer including a basin and a channel from the basin through which air may pass to a suction port at a rear part of the receptacle when the drawer is in an open position and suction is supplied to the port;

a seal integral with the drawer and configured to seal the suction port when the drawer is in the closed position; and an electrical switch operable between an off position when the drawer is in the closed position and an on position when the drawer is in an open position.

15. The assembly of claim 14, further comprising an outlet from the channel to the suction port and wherein the channel extends from a more narrow part of the channel at the basin to a more broad part of the channel at the outlet.

16. The assembly of claim 15, wherein the channel includes:

a tapered section in which the channel tapers from the more narrow part of the channel at the basin to the more broad part of the channel; and a straight section extending along the more broad part of the channel to the outlet.

17. An assembly for receiving debris into a suction debris collection system, the assembly comprising:

a receptacle characterized by a floor, a ceiling, and walls extending between the floor and the ceiling, the floor, the ceiling, and the walls defining a bay and the receptacle having an opening therein at a rear part of the bay;

a drawer slideable in the receptacle bay between a single closed position and an open position, the drawer comprising a generally Y-shaped chamber forming a basin at a more broad forward part of the chamber along the legs of the Y and forming a channel from the basin at a more narrow rearward part of the chamber along the stem of the Y; and a seal integral with the drawer and configured to seal the opening when the drawer is in the closed position.

18. The assembly of claim 17, further comprising an outlet from the channel and wherein the channel extends from a more narrow part of the channel at the basin to a more broad part of the channel at the outlet.

19. The assembly of claim 17, further comprising an electrical switch mounted to the receptacle such that moving the drawer from the closed position to an open position turns on the switch and moving the drawer from an open position to the closed position turns off the switch.

20. The assembly of claim 17, further comprising an electrical rocker switch mounted to the receptacle such that moving the drawer from the closed position to an open position rocks the switch to the on position and moving the drawer from an open position to the closed position rocks the switch to the off position.

* * * * *